US009034548B2

(12) United States Patent
Moritani et al.

(10) Patent No.: US 9,034,548 B2
(45) **Date of Patent: *May 19, 2015**

(54) TONER AND IMAGE FORMING METHOD

(71) Applicant: Ricoh Company, Ltd., Tokyo (JP)

(72) Inventors: Tatsuru Moritani, Shizuoka (JP); Hiroshi Yamashita, Shizuoka (JP); Tsuyoshi Sugimoto, Shizuoka (JP); Daisuke Asahina, Shizuoka (JP); Rintaro Takahashi, Miyagi (JP); Susumu Chiba, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 14 days.

This patent is subject to a terminal disclaimer.

(21) Appl. No.: 13/709,746

(22) Filed: Dec. 10, 2012

(65) Prior Publication Data

US 2013/0157193 A1 Jun. 20, 2013

(30) Foreign Application Priority Data

Dec. 14, 2011 (JP) ..... 2011-273351

(51) Int. Cl.

| | |
|---|---|
| ***G03G 9/00*** | (2006.01) |
| ***G03G 9/087*** | (2006.01) |
| ***G03G 13/00*** | (2006.01) |
| ***G03G 9/093*** | (2006.01) |

(52) U.S. Cl.

CPC ..... *G03G 9/08728* (2013.01); *G03G 9/08755* (2013.01); *G03G 9/08764* (2013.01); *G03G 9/08797* (2013.01); *G03G 9/09321* (2013.01); *G03G 9/09371* (2013.01); *G03G 9/09378* (2013.01)

(58) Field of Classification Search

CPC ..... G03G 9/08728; G03G 9/08755; G03G 9/08764; G03G 9/09378; G03G 9/09321; G03G 9/09371; G03G 9/08797

USPC ..... 430/109.1, 109.4, 110.1, 110.2, 123.54, 430/124.1

See application file for complete search history.

(56) References Cited

U.S. PATENT DOCUMENTS

| | | | | |
|---|---|---|---|---|
| 4,620,987 | A | 11/1986 | Yamashita et al. | |
| 4,885,350 | A | 12/1989 | Yamashita et al. | |
| 5,368,972 | A | 11/1994 | Yamashita et al. | |
| 5,541,031 | A | 7/1996 | Yamashita et al. | |
| 5,576,393 | A | 11/1996 | Yamashita et al. | |
| 6,140,000 | A | 10/2000 | Yamashita | |
| 6,329,115 | B1 | 12/2001 | Yamashita | |
| 6,416,914 | B1 | 7/2002 | Nakamura et al. | |
| 6,632,579 | B1 | 10/2003 | Yamashita | |
| 7,214,461 | B2 | 5/2007 | Yamashita et al. | |
| 2003/0077536 | A1 | 4/2003 | Yamashita et al. | |
| 2003/0162112 | A1 | 8/2003 | Yamashita et al. | |
| 2003/0219669 | A1 | 11/2003 | Yamashita et al. | |
| 2004/0234878 | A1* | 11/2004 | Miyazaki et al. | 430/108.1 |
| 2005/0196692 | A1 | 9/2005 | Yamashita et al. | |
| 2006/0068312 | A1 | 3/2006 | Yamashita et al. | |
| 2006/0177756 | A1 | 8/2006 | Sugimoto et al. | |
| 2006/0292482 | A1 | 12/2006 | Yamashita et al. | |
| 2007/0015077 | A1 | 1/2007 | Yamashita et al. | |
| 2008/0070151 | A1 | 3/2008 | Sugimoto et al. | |
| 2008/0318148 | A1 | 12/2008 | Sugimoto et al. | |
| 2009/0092917 | A1 | 4/2009 | Sugimoto et al. | |
| 2009/0214973 | A1 | 8/2009 | Sugimoto et al. | |
| 2009/0280423 | A1* | 11/2009 | Yahiro et al. | 430/108.4 |
| 2010/0035170 | A1 | 2/2010 | Sugimoto et al. | |
| 2011/0053071 | A1 | 3/2011 | Miki et al. | |
| 2011/0076607 | A1 | 3/2011 | Sugimoto et al. | |
| 2013/0059247 | A1* | 3/2013 | Sugimoto et al. | 430/109.4 |

FOREIGN PATENT DOCUMENTS

| | | |
|---|---|---|
| JP | 2579150 | 11/1996 |
| JP | 11-133665 | 5/1999 |
| JP | 2001-158819 | 6/2001 |
| JP | 2002-287400 | 10/2002 |
| JP | 2002-351143 | 12/2002 |
| JP | 2004-046095 | 2/2004 |
| JP | 2007-271789 | 10/2007 |
| JP | 2010-175933 | 8/2010 |
| JP | 2011-013570 | 1/2011 |
| JP | 2011-070179 | 4/2011 |

* cited by examiner

*Primary Examiner* — Thorl Chea

(74) *Attorney, Agent, or Firm* — Oblon, McClelland, Maier & Neustadt, L.L.P.

(57) ABSTRACT

A toner containing colorant, releasing agent, and binder resin containing crystalline polyester resin, and non-crystalline polyester resin containing urethane bond, urea bond, or both, the non-crystalline polyester resin containing first and second non-crystalline polyester resins, both containing urethane bond, or urea bond, or both, wherein monomers constituting the first non-crystalline polyester resin contains isocyanate monomer for forming the urethane bond, the urea bond, or the both, in an amount of 0.5 mol % or greater to total amount of the monomers, monomers constituting the second non-crystalline polyester resin contain isocyanate monomer for forming the urethane bond, the urea bond, or the both, in an amount of 0.5 mol % or greater to total amount of the monomers, the first non-crystalline polyester resin has Tg of −60° C. or higher but lower than 10° C., and the second non-crystalline polyester resin has Tg of 30° C. or higher but lower than 70° C.

14 Claims, 5 Drawing Sheets

TONER AND IMAGE FORMING METHOD

BACKGROUND OF THE INVENTION

1. Field of the Invention

The present invention relates to a toner and an image forming method using the toner.

2. Description of the Related Art

Recently, there are needs for a toner, which has down-sized particle diameter for achieving high quality output images, has hot offset resistance, has low temperature fixing ability for energy saving, and heat resistant storage stability for enduring the high temperature high humidity environment during storage or transporting after the production thereof. Especially, the electric power consumed during the fixing occupies a large proportion of the electric power consumed in the image formation, and therefore it is very important to improve low temperature fixing ability of the toner.

In the art, a toner produced by a kneading-pulverizing method has been used. A toner produced by the conventional kneading-pulverizing method has irregular shapes with a broad particle size distribution, and it is difficult to obtain smaller particle diameters of a toner by such a method. Therefore, such toner has problems that quality of output images is not sufficiently high, and energy required for fixing is high. In the case a toner contains wax (a releasing agent) for improving a fixing ability, the toner produced by the kneading-pulverizing method has a large amount of the wax present at surfaces of toner particles, as the kneaded product is cracked at the surface of the wax by the pulverization to produce the toner particles. For this reason, the releasing effect is enhanced, but the toner tends to deposit (cause filming) on a carrier, a photoconductor, and a blade. Therefore, such the toner does not have satisfactory characteristics on the whole.

In order to solve the aforementioned problems associated with the kneading-pulverizing method, proposed is a production method of a toner by a polymerization method. The toner produced by this polymerization method can be easily made to have small particle diameters, and has a sharper particle size distribution than that of the toner obtained by the pulverization method, and moreover the releasing agent can be encapsulated in the toner particles. As the toner production method using the polymerization method, disclosed is a method for producing a toner using an elongation reaction product of urethane-modified polyester, as a toner binder, for the purpose of improving low temperature fixing ability and hot offset resistance (see, for example, Japanese Patent Application Laid-Open (JP-A) No. 11-133665).

Moreover, disclosed is a production method of a toner, which is excellent in both powder flowability and transfer properties with small particle diameters, and is also excellent in heat resistant storage stability, low temperature fixing ability, and hot offset resistance (see, for example, JP-A Nos. 2002-287400 and 2002-351143).

Furthermore, disclosed is a toner production method, which produces a toner binder having stable molecular weight distribution, and has an aging step for achieving both low temperature fixing ability and hot offset resistance of the toner (see for example, Japanese Patent (JP-B) No. 2579150, and JP-A No. 2001-158819).

However, these disclosed techniques do not satisfy a high level of low temperature fixing ability of a toner, which has been recently demanded.

For the purpose of attaining a high level of low temperature fixing ability, disclosed is a toner, which contains a resin including a crystalline polyester resin, and a releasing agent, and which has a see-islands phase separation structure, where the resin and the was are incompatible to each other (see, for example, JP-A No. 2004-46095).

Further, disclosed is a toner containing a crystalline polyester resin, a releasing agent, and a graft polymer (see, for example, JP-A No. 2007-271789).

In accordance with these disclosed techniques, low temperature fixing ability is achieved because a crystalline polyester resin is sharply melted compared to a non-crystalline polyester resin. However, even when the crystalline polyester resin being present as island in the sea-island structure is melted, the non-crystalline polyester resin, which is present as sea that constitutes a large part of the toner particle, is not melted. Unless both the crystalline polyester resin and the non-crystalline polyester resin are melted to a certain degree, the toner cannot be fixed. Accordingly, these disclosed toners do not satisfy a high level of low temperature fixing ability, improvement of which has been further demanded recently. Moreover, in order to further improve low temperature fixing ability of a toner, co-melting of a non-crystalline polyester resin and a crystalline polyester resin can be achieved by a method for lowering glass transition temperature, and a method for reducing a molecular weight. In the case where glass transition temperature and a molecular weight of a non-crystalline polyester resin are simply reduced, a resulting toner has excellent low temperature fixing ability, but it is easily expect that hot offset resistance will occur and heat resistant storage stability of the toner will be degraded because of excessively low melt viscosity of the toner.

Accordingly, there are currently needs for a toner, which has excellent low temperature fixing ability, maintains stable fixing ability in a high temperature region, and has excellent heat resistant storage stability, and a developer containing such toner.

SUMMARY OF THE INVENTION

The present invention aims to the aforementioned various problems in the art, and achieving the following object.

An object of the present invention is to provide a toner having an excellent heat resistant storage stability, while maintaining excellent low temperature fixing ability and stable fixing ability in a high temperature range.

Means for solving the problems are as follows:

The toner of the present invention contains:

a colorant;

a releasing agent; and a binder resin, wherein the binder resin contains a crystalline polyester resin, and a non-crystalline polyester resin containing a urethane bond, or a urea bond, or both thereof, where the non-crystalline polyester resin containing a urethane bond, or a urea bond, or both thereof contains a first non-crystalline polyester resin containing a urethane bond, or a urea bond, or both thereof, and a second non-crystalline polyester resin containing a urethane bond, or a urea bond, or both thereof, wherein monomers constituting the first non-crystalline polyester resin contain an isocyanate monomer for forming the urethane bond, or the urea bond, or the both thereof, in an amount of 0.5 mol % or greater relative to a total amount of the monomers, wherein monomers constituting the second non-crystalline polyester resin contain an isocyanate monomer for forming the urethane bond, or the urea bond, or the both thereof, in an amount of 0.5 mol % or greater relative to a total amount of the monomers, wherein the first non-crystalline polyester resin has glass transition temperature of −60° C. or higher but lower than 10° C., and wherein the second non-crystalline polyester resin has glass transition temperature of 30° C. or higher but lower than 70° C.

The present invention can solve the aforementioned various problems in the art, and can provide a toner having an excellent heat resistant storage stability, while maintaining excellent low temperature fixing ability and stable fixing ability in a high temperature range.

DETAILED DESCRIPTION OF THE INVENTION (Toner)

Figure 1:
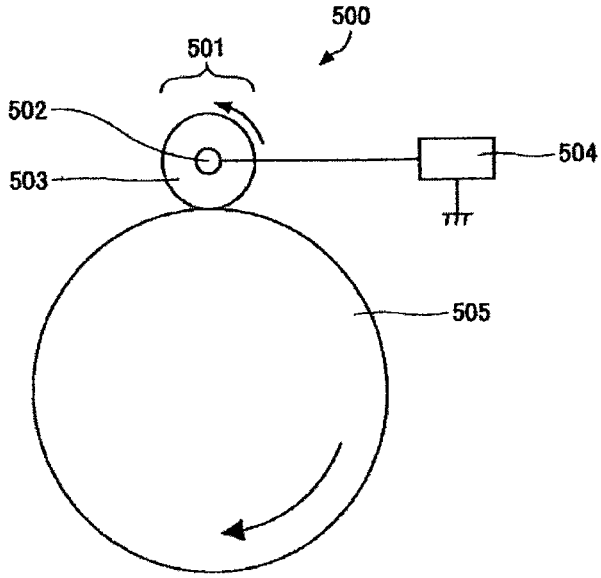
FIG. 1 is a schematic diagram illustrating one example of a contact roller charging device.

The toner of the present invention contains at least a colorant, a releasing agent, and a binder resin, and may further contain other components, if necessary.

The binder resin contains a crystalline polyester resin, and a non-crystalline polyester resin containing a urethane bond and/or a urea bond.

The non-crystalline polyester resin containing a urethane bond and/or a urea bond contains a first non-crystalline polyester resin containing a urethane bond and/or a urea bond (may be referred to as a "first non-crystalline polyester resin" hereinafter), and a second non-crystalline polyester resin containing a urethane bond and/or a urea bond (may be referred to as a "second non-crystalline polyester resin" hereinafter).

Monomers constituting the first non-crystalline polyester resin contain an isocyanate monomer for forming the urethane bond and/or urea bond, and an amount of the isocyanate monomer is 0.5 mol % or greater relative to a total amount of the monomers constituting the first non-crystalline polyester resin.

Monomers constituting the second non-crystalline polyester resin contain an isocyanate monomer for forming the urethane bond and/or urea bond, and an amount of the isocyanate monomer is 0.5 mol % or greater relative to a total amount of the monomers constituting the second non-crystalline polyester resin.

The glass transition temperature of the first non-crystalline polyester resin is −60° C. or higher, but lower than 10° C.

The glass transition temperature of the second non-crystalline polyester resin is 30° C. or higher, but lower than 70° C.

As a result of the researches diligently conducted by the present inventors, it has been found that the following toner maintains both low temperature fixing stability and stable fixing ability in the high temperature range, and has excellent heat storage stability, to thereby accomplish the present invention. Specifically, the toner contains: a colorant; a releasing agent; and a binder resin, wherein the binder resin contains a crystalline polyester resin, and a non-crystalline polyester resin containing a urethane bond, or a urea bond, or both thereof, where the non-crystalline polyester resin containing a urethane bond, or a urea bond, or both thereof contains a first non-crystalline polyester resin containing a urethane bond, or a urea bond, or both thereof, and a second non-crystalline polyester resin containing a urethane bond, or a urea bond, or both thereof, wherein monomers constituting the first non-crystalline polyester resin contains an isocyanate monomer for forming the urethane bond, or the urea bond, or the both thereof, in an amount of 0.5 mol % or greater relative to a total amount of the monomers, wherein monomers constituting the second non-crystalline polyester resin contain an isocyanate monomer for forming the urethane bond, or the urea bond, or the both thereof, in an amount of 0.5 mol % or greater relative to a total amount of the monomers, wherein the first non-crystalline polyester resin has glass transition temperature of −60° C. or higher but lower than 10° C., and wherein the second non-crystalline polyester resin has glass transition temperature of 30° C. or higher but lower than 70° C.

Since the first non-crystalline polyester resin has low glass transition temperature, the fist non-crystalline polyester resin has characteristics that it deforms at low temperature, deforms by the heat and pressure applied during the fixing, and tends to adhered to a recording medium, such as paper, at lower temperature. Moreover, the first non-crystalline polyester resin has at least either a urethane bond or urea bond, both of which has high cohesive energy, and therefore the first non-crystalline polyester resin has excellent adhesion to a recording medium, such as paper. Moreover, the molecular skeleton for forming a toner has a branched structure, and the urethane bond site or urea bond site having high cohesive energy acts as a crosslink point, and therefore, the molecular chain forms a three-dimensional network structure. As a result, the first non-crystalline polyester resin has a rubbery characteristic that it deforms at low temperature but it does not flow, it is possible to achieve both heat resistant storage stability and hot offset resistance of the toner.

Specifically, by compounding the first non-crystalline polyester resin that has glass transition temperature in a very low temperature range, but it has high melt viscosity and hardly flows, with another second non-crystalline polyester resin, it is possible to attain both heat resistant storage stability and hot offset resistance even when glass transition temperature is set lower than that of a conventional toner, and a low temperature fixing ability of the toner can be attained. It is preferred that the first non-crystalline polyester resin and the non-crystalline polyester resin be compatible to each other to form a composite.

The first non-crystalline polyester resin contains, all the monomers constituting the first non-crystalline polyester resin, an isocyanate monomer for forming a urethane bond and/or a urea bond, in an amount of 0.5 mol % or greater relative to all the monomers.

Moreover, the second non-crystalline polyester resin contains, all the monomers constituting the second non-crystalline polyester resin, an isocyanate monomer for forming a urethane bond and/or a urea bond, in an amount of 0.5 mol % or greater relative to all the monomers.

The concentration of the urethane bond or the urea bond increases as the proportion of the isocyanate monomer in all the monomers increases. When the amount of the isocyanate monomer is less than 0.5 mol %, there are less urethane bonds and urea bonds having high cohesive force, and therefore heat resistant storage stability of a resulting toner is lowered.

An amount of the non-crystalline polymer resin containing a urethane bond and/or a urea bond contained in the toner is appropriately selected depending on the intended purpose without any limitation, but it is preferably 65% by mass or greater.

<Binder Resin>

The binder resin contains at least a crystalline polyester resin, and a non-crystalline polyester resin containing a urethane bond and/or a urea bond, and may further contain other components, if necessary.

—Non-Crystalline Polyester Resin Containing Urethane Bond and/or Urea Bond—

The non-crystalline polyester resin containing a urethane bond and/or a urea bond contains at least a first non-crystalline polyester resin containing a urethane bond and/or a urea bond, and a second non-crystalline polyester resin containing a urethane bond and/or a urea bond, and may further contain other components, if necessary.

—First Non-Crystalline Polyester Resin—

The first non-crystalline polyester resin is appropriately selected depending on the intended purpose without any limitation, provided that it is a non-crystalline polyester resin containing a urethane bond and/or a urea bond, but it is preferably a resin formed by reacting a reactive precursor a (prepolymer) having a reaction active site, such as isocyanate, at a terminal thereof, with a curing agent. The reactive precursor a is preferably a non-crystalline polyester resin having a reaction active site, such as isocyanate, at a terminal thereof.

The first non-crystalline polyester resin has glass transition temperature (Tg) of −60° C. or higher but lower than 10° C., as measured by a measuring method of glass transition temperature, which will be described later. When the glass transition temperature thereof is lower than −60° C., fluidity of a toner cannot be inhibited at low temperature, which may lead to poor heat resistant storage stability and hot offset resistance. When the glass transition temperature thereof is 10° C. or higher, heat and pressure applied during fixing cannot sufficiently deform a toner, which may lead to poor low temperature fixing ability of the toner.

The first non-crystalline polyester resin is obtained, for example, by reacting a unmodified polyester resin with isocyanate. Alternatively, the first non-crystalline polyester resin is obtained, for example, by reacting a resin, which is obtained through a reaction between a unmodified polyester resin and isocyanate, with a compound reactive with isocyanate.

The unmodified polyester resin is obtained, for example, by reacting diol, dicarboxylic acid, and optionally trivalent or higher acid or trihydric or higher alcohol that impart a branched structure.

—Diol—

The diol is appropriately selected depending on the intended purpose without any limitation, and examples thereof include: aliphatic diol, such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; oxyalkylene group-containing diol, such as diethylene glycol, triethylene glycol, dipropylene glycol, polyethylene glycol, polypropylene glycol, and polytetramethylene glycol; alicyclic diol such as 1,4-cyclohexane dimethanol, and hydrogenated bisphenol A; alkylene (e.g., ethylene oxide, propylene oxide, and butylene oxide) adducts of the alicyclic diol; bisphenol, such as bisphenol A, bisphenol F, and bisphenol S; and alkylene (e.g., ethylene oxide, propylene oxide, and butylene oxide) adducts of the bisphenol.

In order to lower Tg and impart a deformable characteristic at low temperature to a toner, it is preferred that the aliphatic diol having carbon atoms of 4 or more but less than 12 is contained in an amount of 50% by mass or greater relative to a total amount of the entire diol components.

—Dicarboxylic Acid—

The dicarboxylic acid is appropriately selected depending on the intended purpose without any limitation, and examples thereof include aliphatic dicarboxylic acid, and aromatic dicarboxylic acid.

The aliphatic dicarboxylic acid is appropriately selected depending on the intended purpose without any limitation, and examples thereof include succinic acid, adipic acid, sebacic acid, dodecanedioic acid, maleic acid, and fumaric acid.

The aromatic dicarboxylic acid is appropriately selected depending on the intended purpose without any limitation, but it is preferably C8-C20 aromatic dicarboxylic acid. The C8-C20 aromatic dicarboxylic acid is appropriately selected depending on the intended purpose without any limitation, and examples thereof include phthalic acid, isophthalic acid, terephthalic acid, and naphthalene dicarboxylic acid.

In order to lower Tg and impart a deformable characteristic at low temperature to a toner, it is preferred that, among those listed above, C4-C12 aliphatic dicarboxylic acid be contained in an amount of 50% by mass or greater relative to a total amount of the entire dicarboxylic acid components.

—Trivalent or higher acid and trihydric or higher alcohol—

As a component used for giving a non-linear, i.e. branched, structure to the first non-crystalline polyester resin, conventionally known trihydric or higher alcohol is listed.

Examples of the trihydric or higher alcohol include trihydric or higher aliphatic alcohol, trihydric or higher polyphenol, and alkylene oxide adducts of the trihydric or higher polyphenol.

The trihydric or higher aliphatic alcohol is appropriately selected depending on the intended purpose without any limitation, and examples thereof include glycerin, trimethylol ethane, trimethylol propane, pentaerythritol, and sorbitol.

The trihydric or higher polyphenol is appropriately selected depending on the intended purpose without any limitation, and examples thereof include trisphenol PA, phenol novolak, and cresol novolak.

The alkylene oxide adducts of the trihydric or higher polyphenol include alkylene (e.g., ethylene oxide, propylene oxide, and butylene oxide) adducts of the above-listed trihydric or higher polyphenol.

Examples of the trivalent or higher acid include trivalent or higher aromatic carboxylic acid.

The trivalent or higher aromatic carboxylic acid is appropriately selected depending on the intended purpose without any limitation, but it is preferably C9-C20 trivalent or higher aromatic carboxylic acid.

The C9-C20 trivalent or higher aromatic carboxylic acid is appropriately selected depending on the intended purpose without any limitation, and examples thereof include trimellitic acid, and pyromellitic acid.

As polycarboxylic acid, acid anhydride or lower alkyl ester of the dicarboxylic acid, the trivalent or higher carboxylic acid, or a mixture of the trivalent or higher carboxylic acid and the dicarboxylic acid can be also used. The lower alkyl ester is appropriately selected depending on the intended purpose without any limitation, and examples thereof include methyl ester, ethyl ester, and isopropyl ester.

—Isocyanate—

Examples of the isocyanate include diisocyanate and trivalent or higher polyisocyanate.

Examples of the diisocyanate include C6-C20 (excluding carbon atoms contained in NCO groups, the number of carbon atoms is treated the same below) aromatic diisocyanate, C2-C18 aliphatic diisocyanate, C4-C15 alicyclic diisocyanate, C8-C15 aromatic aliphatic diisocyanate, and modified products (e.g., modified products containing a urethane group, carbodiimide group, allophanate group, urea group, biuret group, uretdione group, uretimine group, isocyanurate group, or oxazolidone group) of these diisocyanates.

These may be used alone or in combination.

Specific examples of the aromatic diisocyanate (inclusive of trivalent or higher polyisocyanate) include 1,3-phenylenediisocyanate, 1,4-phenylenediisocyanate, 2,4-tolylenediisocyanate, 2,6-tolylenediisocyanate (TDI), crude TDI, 2,4'-diphenylmethanediisocyanate, 4,4'-diphenylmethanediisocyanate (MDI), crude MDI [a phosgenated compound of crude diaminophenyl methane [condensation product of formaldehyde and aromatic amine (aniline) or mixture thereof; a mixture of diamino diphenylmethane and a small amount (e.g., 5% by mass to 20% by mass) of trifunctional or higher polyamine]: polyacryl polyisocyanate (PAPI)], 1,5-naphthylenediisocyanate, 4,4',4"-triphenylmetahne triisocyanate, m-isocyanatophenylsulfonyl isocyanate, and p-isocyanatophenylsulfonyl isocyanate.

Specific examples of the aliphatic diisocyanate (inclusive of trivalent or higher polyisocyanate) include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanatohexanoate.

Specific examples of the alicyclic diisocyanate include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

Specific examples of the aromatic aliphatic diisocyanate include m-xylylene diisocyanate, p-xylylene diisocyanate (XDI), and α,α,α',α'-tetramethylxylylene diisocyanate (TMXDI).

Examples of the modified products of the diisocyanate include a urethane group-containing modified product, a carbodiimide group-containing modified product, an allophanate group-containing modified product, a urea group-containing modified product, a biuret group-containing modified product, an uretdione group-containing modified product, an uretimine group-containing modified product, an isocyanurate group-containing modified product, and an oxazolidone group-containing modified product.

The modified product of the diisocyanate, for example, includes: a modified product of diisocyanate, such as modified MDI (e.g., urethane-modified MDI, carbodiimide-modified MDI, and trihydrocarbyl phosphate-modified MDI), and a urethane-modified TDI; and a mixture of two or more of the above-listed modified products [e.g., a combination of modified MDI and urethane-modified TDI (isocyanate-containing prepolymer)].

Among them, preferred are C6-C15 aromatic diisocyanate, C4-C12 aliphatic diisocyanate, and C4-C15 alicyclic diisocyanate, and particularly preferred are 2,4-tolylene diisocyanate, 2,6-tolylene diisocyanate, 2,4'-diphenylmethane diisocyanate, 4,4'-diphenylmethane diisocyanate, hexamethylene diisocyanate, hydrogenated 2,4'-diphenylmethane diisocyanate, hydrogenated 4,4'-diphenylmethane diisocyanate, and isophorone diisocyanate.

—Compound Reactive with Isocyanate—

Examples of the compound reactive with isocyanate include an amine compound.

Examples of the amine compound include diamine, and trivalent or higher polyamine.

Examples of the diamine include aliphatic diamine (C2 to C18), and aromatic diamine (C6 to C20).

Examples of the aliphatic diamine (C2 to C18) include: [1] aliphatic diamine, such as C2-C6 alkyl diamine (e.g., ethylene diamine, propylene diamine, trimethylene diamine, tetramethylene diamine, and hexamethylene diamine), and polyalkylene(C2 to C6) diamine (e.g., diethylene triamine, iminobispropyl amine, bis(hexamethylene)triamine, triethylene tetramine, tetraethylene pentamine, and pentaethylene hexamine); [2] alkyl(C1 to C4) or hydroxyalkyl(C2 to C4) substituents thereof, such as dialkyl(C1 to C3) aminopropyl amine, trimethylhexamethylene diamine, aminoethyl ethanol amine, 2,5-dimethyl-2,5-hexamethylene diamine, and methyliminobispropyl amine; alicyclic or heterocyclic aliphatic diamine, such as C4-C15 alicyclic diamine (e.g., 1,3-diaminocyclohexane, isophorone diamine, menthane diamine, 4,4'-methylene dicyclohexane diamine (hydrogenated methylene dianiline)), and C4-C15 heterocyclic diamine (e.g., piperazine, N-aminoethyl piperazine, 1,4-diaminoethyl piperazine, 1,4-bis(2-amino-2-methylpropyl)piperazine, and 3,9-bis(3-aminopropyl)-2,4,8,10-tetraoxaspiro[5,5]undecane); and [4] aromatic ring-containing aliphatic amine (C8 to C15), such as xylylene diamine, and tetrachloro-p-xylylene diamine.

Examples of the aromatic diamine (C6 to C20) include: [1] unsubstituted aromatic diamine, such as 1,2-phenylenediamine, 1,3-phenylenediamine, 1,4-phenylenediamine, 2,4'-diphenylmethanediamine, 4,4'-diphenylmethanediamine, crude diphenylmethane diamine (polyphenyl polymethylene polyamine), diaminodiphenyl sulfone, benzidine, thiodianiline, bis(3,4-diaminophenyl)sulfone, 2,6-diaminopyridine, m-aminobenzyl amine, triphenylmethane-4,4',4"-triamine, and naphthylene diamine; [2] aromatic diamine containing a nuclear substituted alkyl group (e.g., C1-C4 alkyl groups including methyl, ethyl, n- and i-propyl, and butyl), such as 2,4-tolylene diamine, 2,6-tolylene diamine, crude tolylene diamine, diethyl tolylene diamine, 4,4'-diamino-3,3'-dimethyldiphenylmethane, 4,4'-bis(o-toluidine), dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenyl ether, 3,3',5,5'-tetraisopropyl-4,4'-diaminodiphenyl sulfone, and a mixture of isomers of the foregoing with various ratios; [3] aromatic diamine containing a nuclear substituted electron-withdrawing group (e.g., halogen such as Cl, Br, I, F; an alkoxy group, such as methoxy and ethoxy; and a nitro group), such as methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline; 4,4'-diamino-3,3'-dimethyl-5,5'-dibromo-diphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), and 4-aminophenyl-2-chloroaniline; and [4] aromatic diamine having a secondary amino group [part or entire part of —$NH_2$ of the aromatic diamine [1] to [3] is substituted with —NH—R' (R' is an alkyl group (e.g., a lower alkyl group, such as methyl, and ethyl))], such as 4,4'-di(methylamino)diphenylmethane, and 1-methyl-2-methylamino-4-aminobenzene.

Other examples of the amine compound include: polyamide polyamine [low molecular weight polyamide polyamine obtained by condensing dicarboxylic acid (e.g., dimer acid) and an excess amount (two moles or more per mole of acid) of polyamine (alkylene diamine listed above, polyalkylene polyamine); and polyether polyamine, such as a hydrogenated compound of a cyanoethylated compound of polyether polyol (e.g., polyalkylene glycol).

—Second Non-Crystalline Polyester Resin—

Similarly to the first non-crystalline polyester resin, the second non-crystalline polyester resin contains a urethane bond and/or a urea bond.

The second non-crystalline polyester resin has glass transition temperature of 30° C. or higher but lower than 70° C., as measured by a measuring method of glass transition temperature described later. When the glass transition temperature thereof is lower than 30° C., heat resistant storage stability of a resulting toner, and resistance of the toner to stress caused in a developing unit, such as by stirring may be poor. When the glass transition temperature thereof is 70° C. or higher, viscoelasticity of a toner as melted becomes high, which may impair low temperature fixing ability.

Examples of components constituting the second non-crystalline polyester resin include diol, dicarboxylic acid, trivalent or higher acid, trihydric or higher alcohol, and isocyanate. Specific examples thereof are the same to those listed in the descriptions for the first non-crystalline polyester resin.

In the present invention, the second non-crystalline polyester resin may contain trivalent or higher polycarboxylic acid (e.g., trimellitic acid, pyromellitic acid, and anhydrides thereof) or trihydric or higher alcohol (e.g., glycerin, pentaerythritol, and trimethylol propane) at a terminal of a molecular chain thereof, for the purpose of controlling an acid value or hydroxyl value.

A production method of the second non-crystalline polyester resin is appropriately selected depending on the intended purpose without any limitation, and for example, it can be produced in the same manner as in the production method of the first non-crystalline polyester resin. Moreover, the second non-crystalline polyester resin can be obtained, for example, by reacting trivalent or higher carboxylic acid with a resin obtained through a reaction between a unmodified polyester resin and isocyanate.

An acid value of the second non-crystalline polyester resin is appropriately selected depending on the intended purpose without any limitation, but it is preferably 1 mgKOH/g to 50 mgKOH/g, more preferably 5 mgKOH/g to 30 mgKOH/g. When the acid value thereof is 1 mgKOH/g or greater, a resulting toner tends to be negatively charged, and an affinity between the toner and paper increases during fixing to the paper. Accordingly, low temperature fixing ability of the toner is improved. When the acid value is greater than 50 mgKOH/g, however, charge stability, especially charge stability over environmental changes, may be degraded.

A hydroxyl value of the second non-crystalline polyester resin is appropriately selected depending on the intended purpose without any limitation, but it is preferably 5 mgKOH/g or greater.

The molecular structures of the first non-crystalline polyester resin and the second non-crystalline polyester resin can be confirmed by subjecting a solution or solid thereof to NMR spectroscopy, X-ray diffraction spectroscopy, GC/MS, LC/MS, or IR spectroscopy. As for a simple method, usable is a method for detecting, in an IR absorption spectrum, the one that does not have absorption peaks derived from SCH (out plane bending) of olefine at 965±10 $cm^{-1}$ and 990±10 $cm^{-1}$, as a non-crystalline polyester resin.

—Crystalline Polyester Resin—

The crystalline polyester resin has high crystallinity, and therefore exhibits thermal melting characteristics that viscosity thereof rapidly decreases at around fixing onset temperature. By using the crystalline polyester resin having the aforementioned characteristics together with the first non-crystalline polyester resin and the second non-crystalline polyester resin, a toner having both excellent heat resistant storage stability and low temperature fixing ability can be obtained, because excellent heat resistant storage ability is obtained due to crystallinity just below the melt onset temperature, and sharp melting occurs at the melt onset temperature due to melting of the crystalline polyester to thereby sharply decrease the viscosity to be fixed. Moreover, such toner also has desirable releasing width (a difference between the minimum fixing temperature and hot offset occurring temperature).

The crystalline polyester resin is obtained, for example, by using a polyhydric alcohol component, and a polyvalent carboxylic acid component, such as polyvalent carboxylic acid, polyvalent carboxylic anhydride, and polyvalent carboxylic acid ester.

—Polyhydric Alcohol Component—

The polyhydric alcohol component is appropriately selected depending on the intended purpose without any limitation, and examples thereof include diol, and trihydric or higher alcohol.

Examples of the diol include saturated aliphatic diol. Examples of the saturated aliphatic diol include linear-chain saturated aliphatic diol, and branched saturated aliphatic diol. Among them, the linear-chain saturated aliphatic diol is preferable, and C4-C12 linear-chain saturated aliphatic diol is more preferable. When the saturated aliphatic diol has a branched structure, crystallinity of the crystalline polyester resin is low, and a melting point thereof may become low. Moreover, when the number of the carbon atoms contained in the principal chain is less than 4, melting temperature thereof becomes high at the time when it is subjected to a polycondensation reaction with aromatic dicarboxylic acid, and therefore it may be difficult to achieve low temperature fixing ability of a resulting toner. When the number of the carbon atoms is more than 12, it is difficult to obtain a material that can be used in practices. The number of the carbon atoms is preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-ocatadecanediol, and 1,14-eicosanedecane diol. Among them, preferred are 1,4-butanediol, 1,6-hexanediol, 1,8-octanediol, 1,10-decanediol, and 1,12-dodecanediol in view of high crystallinity and excellent sharp melt properties of the crystalline polyester resin.

Examples of the trihydric or higher alcohol include glycerin, trimethylol ethane, trimethylol propane, and pentaerythritol.

These may be used alone or in combination.

—Polyvalent Carboxylic Acid Component—

The polyvalent carboxylic acid component is appropriately selected depending on the intended purpose without any limitation, and examples thereof include bivalent carboxylic acid, and trivalent or higher carboxylic acid.

Examples of the bivalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acid, such as phthalic acid, isophthalic acid, terephthalic acid, naphthalene-2,6-dicarboxylic acid, dibasic acid (e.g., malonic acid, and mesaconic acid); anhydride thereof and lower alkyl ester thereof.

Examples of the trivalent or higher carboxylic acid include 1,2,4-benzenetricarboxylic acid, 1,2,5-benzenetricarboxylic acid, 1,2,4-naphthalene trivarboxylic acid, anhydride thereof, and lower alkyl ester thereof.

Moreover, the polyvalent carboxylic acid component may contain, other than the saturated aliphatic dicarboxylic acid or aromatic dicarboxylic acid, a dicarboxylic acid component having a sulfonic acid group. Further, the polyvalent carboxylic acid component may contain, other than the saturated aliphatic dicarboxylic acid or aromatic dicarboxylic acid, a dicarboxylic acid component having a double bond.

These may be used alone or in combination.

The crystalline polyester resin preferably contain a constitutional unit derived from saturated aliphatic dicarboxylic acid having carbon atoms of 4 or more but less than 12, and a constitutional unit derived from saturated aliphatic diol having carbon atoms of 2 or more but less than 12, because of high crystallinity and excellent sharp melt properties, which lead to excellent low temperature fixing ability.

A melting point of the crystalline polyester resin is appropriately selected depending on the intended purpose without any limitation, but it is preferably 60° C. or higher but lower than 80° C. When the melting point thereof is lower than 60° C., the crystalline polyester resin tend to melt at low temperature, which may impair heat resistant storage stability of a resulting toner. When the melting point thereof is 80° C. or higher, the crystalline polyester resin is melted insufficiently with heat applied during fixing, which may impair low temperature fixing ability of a resulting toner.

The melting point can be determined from an endothermic peak value in a DSC chard thereof as measured by differential scanning calorimetry (DSC).

A molecular weight of the crystalline polyester resin is appropriately selected depending on the intended purpose without any limitation. Since the crystalline polyester having a sharp molecular weight distribution and low molecular weight gives excellent low temperature fixing ability, and a large amount of the low molecular weight component thereof adversely affects heat resistant storage stability of a resulting toner, a ortodichlorobenzene soluble component of the crystalline polyester resin has preferably the weight average molecular weight (Mw) of 3,000 to 30,000, the number average molecular weight (Mn) of 1,000 to 10,000, and a ratio Mw/Mn of 1.0 to 10, as measured by gel permeation chromatography.

Further, it is more preferred that the weight average molecular weight (Mw) thereof be 5,000 to 15,000, the number average molecular weight (Mn) thereof be 2,000 to 10,000, and the ratio Mw/Mn be 1.0 to 5.0.

An acid value of the crystalline polyester resin is appropriately selected depending on the intended purpose without any limitation. In order to achieve desirable low temperature fixing ability under consideration of affinity between paper and a resin, the acid value thereof is preferably 5 mgKOH/g or higher, more preferably 10 mgKOH/g or higher. In order to improve hot offset resistance, on the other hand, the acid value thereof is preferably 45 mgKOH/g or lower.

A hydroxylic value of the crystalline polyester resin is appropriately selected depending on the intended purpose without any limitation. In order to achieve desirable low temperature fixing ability and excellent charging characteristics, the hydroxylic value thereof is preferably 0 mgKOH/g to 50 mgKOH/g, more preferably 5 mgKOH/g to 50 mgKOH/g.

The molecular structure of the crystalline polyester resin and the second non-crystalline polyester resin can be confirmed by subjecting a solution or solid thereof to NMR spectroscopy, X-ray diffraction spectroscopy, GC/MS, LC/MS, or IR spectroscopy. As for a simple method, usable is a method for detecting, in an IR absorption spectrum, the one that does not have absorption peaks derived from δCH (out plane bending) of olefine at 965±10 $cm^{-1}$ or 990±10 $cm^{-1}$, as a crystalline polyester resin.

An amount of the crystalline polyester resin in the toner is appropriately selected depending on the intended purpose without any limitation, but it is preferably 2.0% by mass to 20% by mass, more preferably 4.8% by mass to 15% by mass. When the amount thereof is smaller than 2.0% by mass, the crystalline polyester resin does not provide sufficient sharp melt properties to a resulting toner, and therefore low temperature fixing ability of the toner may be poor. When the amount thereof is grater than 20% by mass, heat resistant storage stability of a resulting toner may be poor, and fogging of an image may be caused. When the amount thereof is within the aforementioned more preferable range, it is advantageous because all of image quality, stability and low temperature fixing ability are excellent.

<Releasing Agent>

The releasing agent is not particularly limited, and is appropriately selected from releasing agents known in the art.

Examples of the wax serving as the releasing agent include natural wax, such as vegetable wax (e.g. carnauba wax, cotton wax, Japan wax, and rice wax), animal wax (e.g., bees wax and lanolin), mineral wax (e.g., ozokelite and ceresin), and petroleum wax (e.g., paraffin wax, microcrystalline wax and petrolatum).

Examples of the wax other than the natural wax listed above include: synthetic hydrocarbon wax (e.g., Fischer-Tropsch wax and polyethylene wax); and synthetic wax (e.g., ester wax, ketone wax and ether wax).

Further examples include: a fatty acid amide compound, such as 1,2-hydroxystearic acid amide, stearic amide, phthalic anhydride imide and chlorinated hydrocarbons; low-molecular-weight crystalline polymer resins such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, hydrocarbon wax, such as paraffin wax, microcrystalline wax, Fischer-Tropsch wax, polyethylene wax, and polypropylene wax are preferable.

A melting point of the releasing agent is appropriately selected depending on the intended purpose, but it is preferably 60° C. or higher, but lower than 80° C. When the melting point thereof is lower than 60° C., the releasing agent tends to melt at low temperature, which may lead to poor heat resistant storage stability of a resulting toner. When the melting point thereof is 80° C. or higher, the releasing agent is not sufficiently melted, whereas the binder resin is melted in a fixing temperature range, to cause fixing offset. Therefore, image defects may be formed.

An amount of the releasing agent in the toner is appropriately selected depending on the intended purpose without any limitation, but it is preferably 2% by mass to 10% by mass, more preferably 3% by mass to 8% by mass. When the amount thereof is smaller than 2% by mass, hot offset resistance and low temperature fixing ability during fixing may be insufficient. When the amount thereof is greater than 10% by mass, heat resistant storage stability may be poor, and fogging of an image may be caused. When the amount thereof is within the aforementioned more preferable range, it is advantageous because image quality and fixing stability can be improved.

<Colorant>

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine, iron blue, anthraquinone blue, fast violet B, methylviolet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant in the toner is appropriately selected depending on the intended purpose without any limitation, but it is preferably 1% by mass to 15% by mass, more preferably 3% by mass to 10% by mass.

The colorant can be used as a master batch in which the colorant forms a composite with a resin. The resin used for production of the master batch or kneaded together with the master batch includes the first non-crystalline polyester resin and the second non-crystalline polyester resin. Other examples of the resin include: styrene polymer and substituted products thereof (e.g., polystyrene, poly-p-chlorostyrene and polyvinyltoluene); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl a-chloro methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer); polymethyl methacrylate; polybutyl methacrylate; polyvinyl chloride; polyvinyl acetate; polyethylene; polypropylene; polyester; an epoxy resin; an epoxy polyol resins; polyurethane; polyamide; polyvinylbutyral; a polyacrylic resin; rosin; modified rosin; a terpene resin; an aliphatic or alicyclic hydrocarbon resin; an aromatic petroleum resin; chlorinated paraffin; and paraffin wax. These may be used alone or in combination.

The master batch can be prepared by mixing or kneading a colorant with the resin for use in the master batch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, a high-shearing disperser (e.g., a three-roll mill) is preferably used.

<Other Components>

Other components are appropriately selected depending on the intended purpose without any restriction. Examples thereof include a charge controlling agent, external additives, a flow improving agent, a cleaning improving agent, a magnetic material, styrene-acryl resin particles, and acryl resin particles.

—Charge Controlling Agent—

The charge controlling agent is appropriately selected depending on the intended purpose without any limitation, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives. Specific examples thereof include BONTRON 03 (nigrosine dye), BONTRON P-51 (quaternary ammonium salt), BONTRON S-34 (metal azo-containing dye), E-82 (oxynaphthoic acid-based metal complex), E-84 (salicylic acid-based metal complex) and E-89 (phenol condensate), all manufactured by ORIENT CHEMICAL INDUSTRIES CO., LTD; TP-302 and TP-415 (quaternary ammonium salt molybdenum complexes) both manufactured by Hodogaya Chemical Co., Ltd.; LRA-901 and LR-147 (boron complexes), both manufactured by Japan Carlit Co., Ltd.; copper phthalocyanine; perylene; quinacridone; and azo pigments.

An amount of the charge controlling agent in the toner is appropriately selected depending on the intended purpose without any limitation, but it is preferably 0.1% by mass to 10% by mass, more preferably 0.2% by mass to 5% by mass. When the amount thereof is greater than 10% by mass, the electrostatic propensity of the resulting toner is excessively large, and therefore an effect of the charge controlling agent is reduced and electrostatic force to a developing roller increases, which may reduce flowability of the toner, or reduce image density of images formed with the resulting toner. The charge controlling agent may be added by dissolving and dispersing after melting and kneading together with the master batch or the resin, or added by dissolving or dispersing directly in the organic solvent, or added by fixing on a surface of each toner particle after the preparation of the toner particles.

—External Additives—

As for the external additives, other than oxide particles, inorganic particles or hydrophobic-treated inorganic particles can be used in combination. The average particle diameter of primary particles of the hydrophobic-treated inorganic particles is preferably 1 nm to 100 nm, more preferably 5 nm to 70 nm.

Moreover, it is preferred that at least the hydrophobic-treated inorganic particles having the average particle diameter of primary particles thereof being 20 nm or smaller and the hydrophobic-treated inorganic particles having the average particle diameter thereof being 30 nm or greater be contained. Further, the BET specific surface area thereof is preferably 20 $m^2/g$ to 500 $m^2/g$.

The external additives are appropriately selected depending on the intended purpose without any limitation, and examples thereof include silica particles, hydrophobic silica, fatty acid metal salts (e.g., zinc stearate, and aluminum stearate), metal oxides (e.g., titania, alumina, tin oxide, and antimony oxide), and fluoropolymer.

As for the external additives, preferred are hydrophobic-treated silica particles, hydrophobic-treated titania particles, and hydrophobic-treated alumina particles.

Examples of the silica particles include R972, R974, RX200, RY200, R202, R805, and R812 (all manufactured by Nippon Aerosil Co., Ltd.).

Examples of the titania particles include: P-25 (manufactured by Nippon Aerosil Co., Ltd.); STT-30, and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION).

Examples of the titanium oxide particles include: T-805 (manufactured by Nippon Aerosil Co., Ltd.); STT-30A, and STT-65S-S (both manufactured by Titan Kogyo, Ltd.); TAF-500T, and TAF-1500T (both manufactured by Fuji Titanium Industry Co., Ltd.); MT-100S, and MT-100T (both manufactured by TAYCA CORPORATION); and ITS (manufactured by ISHIHARA SANGYO KAISHA, LTD.).

As the hydrophobic-treated oxide particles, the hydrophobic-processed oxide particles, hydrophobic-processed silica particles, hydrophobic-processed titania particles, and hydrophobic-processed alumina particles can be obtained, for example, by processing hydrophobic particles with a silane coupling agent such as methyl trimethoxy silane, methyl triethoxy silane, octyl trimethoxy silane, or the like. Moreover, silicone oil-treated oxide particles and inorganic particles, both of which are obtained by processing inorganic particles with silicone oil, optionally with an application of heat, are also suitably used.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl-modified silicone oil, methacryl-modified silicone oil, and α-methyl styrene modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium oxide are preferable.

An amount of the external additives is appropriately selected depending on the intended purpose without any limitation, but it is preferably 0.1% by mass to 5% by mass, more preferably 0.3% by mass to 3% by mass, relative to the toner.

The average diameter of the primary particles of the inorganic particles is appropriately selected depending on the intended purpose without any limitation, but it is preferably 100 nm or smaller, more preferably 3 nm to 70 nm. When the average primary diameter of the inorganic particles is smaller than the more preferable range, the inorganic particles are embedded in the toner particles, and may not be able to exhibits the function thereof. When the average primary diameter thereof is larger than the more preferable range, the inorganic particles may unevenly scratch a surface of a photoconductor, and therefore not preferable.

—Flow Improving Agent—

The flow improving agent is appropriately selected depending on the intended purpose without any restriction, provided that it can perform a surface treatment to improve hydrophobicity so as to prevent the toner from reducing its fluidity and charging properties in high humidity environments. Examples of the flow improving agent include a silane coupling agent, a sililating agent, a silane coupling agent including a fluoroalkyl group, an organic titanate-based coupling agent, silicone oil, and modified silicone oil. The aforementioned silica and titanium oxide are particularly preferably used as hydrophobic silica and hydrophobic titanium oxide, respectively subjected to a surface treatment with the aforementioned flow improving agent.

—Cleaning Improving Agent—

The cleaning improving agent is appropriately selected depending on the intended purpose without any restriction, provided that it is added to the toner in order to remove the residual developer on a photoconductor or a primary transfer member. Examples of the cleaning improving agent include: metal salts of fatty acid such as stearic acid (e.g. zinc stearate, and calcium stearate); and polymer particles produced by soap-free emulsification polymerization. The polymer particles preferably have a relatively narrow particle size distribution, preferably having the volume average particle diameter of 0.01 μm to 1 μm.

—Magnetic Material—

The magnetic material is appropriately selected depending on the intended purpose without any limitation, and examples thereof include iron powder, magnetite, and ferrite. Among them, white magnetic materials are preferable in view of the color tone.

—Styrene/Acryl Resin Particles—

The styrene/acryl resin particles are appropriately selected depending on the intended purpose without any limitation, provided that the constitutional unit of these resin particles contains styrene and a vinyl monomer. Examples thereof include a styrene-(meth)acrylic acid ester resin, a styrene-butadiene copolymer, (meth)acrylic acid-acrylic acid ester polymer, a styrene-acrylonitrile copolymer, a styrene-maleic anhydride copolymer, and a styrene-(meth)acrylic acid copolymer.

The styrene/acryl resin particles preferably contain, in their constitutional unit, a sodium salt of sulfuric acid ester of methacrylic acid-ethylene oxide adduct.

—Acryl Resin Particles—

The acryl resin particles are appropriately selected depending on the intended purpose without any limitation, provided that they are resin particles that are different from the styrene/acryl resin particles, but they are preferably formed of a crosslinked polymer. The acryl resin particles preferably contain in their constitutional unit a monomer having at least two polymerizable unsaturated groups.

The acryl resin particles do not contain styrene.

Examples of a material of the acryl resin particles include polymethyl acrylate polymer, polyethyl acrylate polymer, polybutyl acrylate polymer, polyoctyl acrylate polymer, polymethyl methacrylate polymer, polyethyl methacrylate polymer, polybutyl methacrylate polymer, polymethyl-α-chloromethacrylate polymer, and polyacrylonitrile polymer.

The acyl resin particles are preferably non-compatible to the binder resin.

The volume average particle diameter of the toner is appropriately selected depending on the intended purpose without any limitation, but it is preferably 3 μm to 7 μm. Moreover, a ratio of the volume average particle diameter to the number average particle diameter is preferably 1.2 or lower. Furthermore, it is preferred that the toner contain the particles having the volume average particle diameter of 2 μm or smaller in an amount of 1% by number to 10% by number.

The glass transition temperature (Tg1st) of the toner as measured with the first heating in differential scanning calorimetry is appropriately selected depending on the intended purpose without any limitation, but it is preferably 20° C. or higher but lower than 40° C., more preferably 25° C. or higher but lower than 40° C.

The toner is preferably obtained by dissolving or dispersing, in an organic solvent, a toner material containing the colorant, the releasing agent, and the binder resin, to produce a solution or dispersion liquid of the toner material.

The toner is preferably a toner obtained by granulating in an aqueous system.

The toner particle preferably contains a core particle, and a shell provided on a surface of the core particle, where the core particle contains the colorant, the releasing agent, and the binder resin, and the shell contains a layer formed of the styrene/acryl resin particles, and a layer formed of the acryl resin particles.

The Tg, acid value, hydroxyl value, and molecular weights of the first non-crystalline polyester resin, the second non-crystalline polyester resin, the crystalline polyester resin, and the releasing agent may be each measured per se. Alternatively, each component may be separated from an actual toner by GPC or any other methods, each separated component may be subjected to the analysis methods described layer, to thereby calculate Tg, molecular weight, and a mass ratio of constitutional components.

Specifically, in GPC using tetrahydrofuran (THF) as a mobile phase, an eluate is subjected to fractionation by means of a fraction collector, a fraction corresponding to a part of a desired molecular weight is collected from a total area of an elution curve.

The collected eluates are concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constitutional monomer of the resin in the elution composition is calculated.

As another method, after concentrating the eluate, hydrolysis is performed with sodium hydroxide or the like, and a ratio of a constitutional monomer is calculated by subjecting the decomposed product to a qualitative or quantitative analysis by high performance liquid chromatography (HPLC).

<Analysis of Toner Components>

An example of a method for separating each component of a toner for analysis of the toner will be described hereinafter.

First, 1 g of a toner is added to 100 mL THF, and the resulting mixture is stirred for 30 minutes at 25° C., to thereby a solution in which soluble components are dissolved.

The solution is then filtered through a membrane filter having an opening of 0.2 μm, to thereby obtain the THF soluble components in the toner.

Next, the THF soluble components are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by means of a nuclear magnetic resonance apparatus (JNM-AL 400, manufactured by JEOL Ltd.) by performing multiplication 128 times at temperature of 23° C. to 25° C.

The monomer compositions, and component ratios of the first non-crystalline polyester resin, the second non-crystalline polyester resin, the crystalline polyester resin, and the releasing agent contained in the toner can be determined from peak integral ratios of the obtained spectrum.

For example, an assignment of a peak is performed in the following manner, and a constitutional monomer component ratio is determined from each integral ratio.

The assignment of a peak is as follows:

Around 8.25 ppm: derived from a benzene ring of trimellitic acid (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 3.7 ppm to 4.7 ppm: derived from methylene of a bisphenol A propylene oxide adduct (for two hydrogen atoms), and derived from methylene of a bisphenol A ethylene oxide (for four hydrogen atoms)

Around 1.6 ppm: derived from a methyl group of bisphenol A (for 6 hydrogen atoms).

From these results, for example, the extracted product collected from the fraction in which the first non-crystalline polyester resin occupies 90% or more can be treated as the first non-crystalline polyester resin.

Similarly, the extracted product collected from the fraction in which the second non-crystalline polyester resin occupies 90% or more can be treated as the second non-crystalline polyester resin, and the extracted product collected from the fraction in which the crystalline polyester resin occupies 90% or more can be treated as the crystalline polyester resin. Moreover, the extracted product collected from the fraction in which the releasing agent occupies 90% or more can be treated as the releasing agent.

<Measuring Method of Acid Value and Hydroxyl Value>

The hydroxyl value can be measured by a method in accordance with JIS K0070-1966.

Specifically, 0.5 g of a sample is measured in a 100 mL measuring flask, and to this 5 mL of an acetylation reagent. Next, the mixture is heated for 1 hour to 2 hours in a hot water bath of 100° C.±5° C., and then the flask is taken out from the hot water bath and left to cool. Next, to the resultant, water is added, and the resulting mixture is shaken to decompose acetic anhydride. In order to completely decompose acetic anhydride, the flask is again heated for 10 minutes or longer in a hot water bath and left to cool, followed by sufficiently washing a wall of the flask with an organic solvent.

Further, the hydroxyl value is measured at 23° C. by means of a potentiometric automatic titrator (DL-53 Titrator, manufactured by Mettler-Toledo K.K.) and an electrode DG113-SC (product of Mettler-Toledo K.K.). The measurements are analyzed with an analysis software LabX Light Version 1.00.000. Note that, a mixed solvent of 120 mL of toluene and 30 mL of ethanol is used for calibration of the device.

The measuring conditions are as follows.

[Conditions of Measurement]

| Stir | |
|---|---|
| Speed [%] 25 | |
| Time [s] 15 | |
| EQP titration | |
| Titrant/Sensor | |
| Titrant $CH_3ONa$ | |
| Concentration [mol/L] 0.1 | |
| Sensor DG115 | |
| Unit of measurement mV | |
| Predispensing to volume | |
| Volume [mL] 1.0 | |
| Wait time [s] 0 | |
| Titrant addition | Dynamic |
| dE(set) [mV] | 8.0 |
| dV(min) [mL] | 0.03 |
| dV(max) [mL] | 0.5 |
| Measure mode | Equilibrium controlled |
| dE [mV] | 0.5 |
| dt [s] | 1.0 |
| t(min) [s] | 2.0 |
| t(max) [s] | 20.0 |
| Recognition | |
| Threshold | 100.0 |

-continued

| Steepest jump only No | |
|---|---|
| Range | No |
| Tendency | None |
| Termination | |
| at maximum volume [mL] | 10.0 |
| at potential | No |
| at slope | No |
| after number EQPs | Yes |
| n = 1 | |
| comb. termination conditions | No |
| Evaluation | |
| Procedure | Standard |
| Potential1 | No |
| Potential2 | No |
| Stop for reevaluation | No |

The acid value can be measured by the method according to JIS K0070-1992.

Specifically, 0.5 g of sample (soluble matter in ethyl acetate: 0.3 g) is added to 120 mL of toluene, and the resultant mixture is stirred for about 10 hours at 23° C. for dissolution. Next, ethanol (30 mL) is added thereto to prepare a sample solution. Notably, when the sample is not dissolved in toluene, another solvent such as dioxane or tetrahydrofuran is used. Then, a potentiometric automatic titrator (DL-53 Titrator, manufactured by Mettler-Toledo K.K.) and an electrode DG113-SC (product of Mettler-Toledo K.K.) are used to measure the acid value at 23° C. The measurements are analyzed with analysis software LabX Light Version 1.00.000. Note that, a mixed solvent of 120 mL of toluene and 30 mL of ethanol is used for calibration of the device.

The measuring conditions are the same as in the conditions for the measurement of hydroxyl value as described above.

The acid value can be measured in the manner described above, but specifically, the sample solution is titrated with a pre-standardized 0.1N potassium hydroxide/alcohol solution and then the acid value is calculated from the titration value based on the following formula: Acid value [KOHmg/g]=titration value [mL]×N×56.1 [mg/mL]/mass of sample [g] (N is a factor of 0.1N potassium hydroxide/alcohol solution)

<Measurement Methods of Melting Point and Glass Transition Temperature (Tg)>

In the present invention, a melting point and glass transition temperature (Tg) can be measured, for example, by means of a differential scanning calorimeter (DSC) system (Q-200, manufactured by TA Instruments Japan Inc.).

Specifically, a melting point and glass transition temperature of a sample are measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by means of a differential scanning calorimeter (Q-200, manufactured by TA Instruments Japan Inc.).

The DSC curve for the first heating is selected from the obtained DSC curve by means of an analysis program stored in the Q-200 system, to thereby determine glass transition temperature of the sample with the first heating. Similarly, the DSC curve for the second heating is selected, and the glass transition temperature of the sample with the second heating can be determined.

Moreover, the DSC curve for the first heating is selected from the obtained DSC curve by means of the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the case where a toner is used as a sample, glass transition temperature for the first heating is represented as Tg1st, and glass transition temperature for the second heating is represented as Tg2nd in the present specification.

Moreover, in the present specification, the endothermic peak top temperatures and glass transition temperatures of other constitutional components, such as the non-crystalline polyester resin, crystalline polyester resin, and releasing agent, for the second heating are regarded as melting point and Tg of each sample, unless otherwise stated.

<Method for Measuring Particle Size Distribution>

The volume average particle diameter ($D_4$) and number average particle diameter ($D_n$) of the toner and the ratio thereof ($D_4/D_n$) can be measured, for example, by means of Coulter Counter TA-II or Coulter Multisizer II (both manufactured by Beckman Coulter, Inc.). In the present invention, Coulter Multisizer II is used. The measurement method will be explained below.

First, 0.1 mL to 5 mL of a surfactant (preferably alkyl benzene sulfonate (nonionic surfactant)) was added as a dispersant to 100 mL to 150 mL of an electrolyte. Note that, the electrolyte is an about 1% by mass aqueous solution prepared by using a primary sodium chloride, and for example, ISOTON-II (of Beckman Coulter, Inc.) is used as the electrolyte. Next, to the resulting mixture, 2 mg to 20 mg of a sample is added and suspended, and the mixture is dispersed by means of an ultrasonic wave disperser for about 1 minute to about 3 minutes. The volume and number of the toner particles or toner are measured from the obtained dispersion liquid using the aforementioned measuring device with an aperture of 100 μm, and then the volume distribution and number distribution of the toner are calculated. From the obtained distributions, the volume average particle diameter ($D_4$), and number average particle diameter ($D_n$) of the toner can be determined.

Note that, as a channel, the following 13 channels are used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement are particles having the diameters of 2.00 μm or larger, but smaller than 40.30 μm.

<Measurement of Peak Molecular Weight of Toner>

A molecular weight of each constitutional component of a toner can be measured, for example, by the following method.

Gel permeation chromatography (GPC) measuring device: GPC-8220GPC (manufactured by TOSOH CORPORATION)

Column: TSKgel SuperHZM-H 15 cm, three connected columns (manufactured by TOSOH CORPORATION)

Temperature: 40° C.

Solvent: THF

Flow rate: 0.35 mL/min

Sample: 100 μL of a 0.15% by mass sample to be supplied

As for the pretreatment of the sample, the sample is dissolved in tetrahydrofuran (THF) (containing a stabilizer, manufactured by Wako Chemical Industries, Ltd.) to give a concentration of 0.15% by mass, the resulting solution is then filtered through a filter having a pore size of 0.2 μm, and the filtrate from the filtration is used as a sample. The measurement is performed by supplying 100 μL of the tetrahydrofuran (THF) sample solution. For the measurement of the molecular weight of the sample, a molecular weight distribution of the sample is calculated from the relationship between the logarithmic value of the calibration curve prepared from a several monodispersible polystyrene standard samples and the number of counts. As the standard polystyrene samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene are used. As the detector, a refractive index (RI) detector is used.

<Production Method of Toner>

The production method of the toner is appropriately selected depending on the intended purpose without any limitation, but the toner is preferably granulated by dispersing, in an aqueous medium, an oil phase containing at least the first non-crystalline polyester resin, the second non-crystalline polyester resin, the crystalline polyester resin, the releasing agent, and the colorant.

As one example of such production method of the toner, a conventional dissolution suspension method is mentioned.

As another example of the production method of the toner, a method for forming toner base particles, while generating an elongation reaction and/or crosslink reaction product (may be referred to as an "adhesive base" hereinafter) of the curing agent and the reactive precursor, will be described hereinafter. In this method, a preparation of an aqueous medium, a preparation of an oil phase containing a toner material, emulsification and/or dispersion of the toner material, removal of the organic solvent, and the like are performed.

—Preparation of Aqueous Medium (Aqueous Phase)—

The preparation of the aqueous medium can be performed, for example, by dispersing the styrene/acryl resin particles in an aqueous medium with an anionic surfactant. Amounts of the anionic surfactant and the styrene-acryl resin particles added to the aqueous medium are appropriately selected depending on the intended purpose without any limitation. For example, the anionic surfactant and the styrene-acryl resin particles are each preferably added in an amount of 0.5% by mass to 10% by mass relative to the aqueous medium. The acryl resin particles are then added to the aqueous medium. In the case where the acryl resin particles are cohesive with the anionic surfactant, it is preferred that the acryl resin particles are dispersed in the aqueous medium by a high speed shear disperser before emulsification.

By applying the preparation method of the aqueous medium as described above, toner base particles, in each of which a layer A formed of the styrene/acryl resin particles and a layer B formed of the acryl resin particles are formed as an outer layer on a core particle containing the binder resin, are obtained. The toner base particles having such structures are preferable in view of heat resistant storage stability.

The aqueous medium is appropriately selected depending on the intended purpose without any limitation, and examples thereof include water, a solvent miscible with water, and a mixture of water and the solvent. These may be used alone or in combination. Among them, water is preferable.

The solvent miscible with water is appropriately selected depending on the intended purpose without any restriction. Examples thereof include alcohol, dimethylformamide, tetrahydrofuran, cellosolve, and lower ketones. The alcohol is appropriately selected depending on the intended purpose without any restriction. Examples thereof include methanol, isopropanol, and ethylene glycol. The lower ketone is appropriately selected depending on the intended purpose without any restriction. Examples thereof include acetone, and methyl ethyl ketone.

—Preparation of Oil Phase—

The preparation of the oil phase containing the toner material can be performed, for example, by dissolving and/or dispersing, in an organic solvent, a toner material containing the binder resin, the releasing agent, and the colorant.

The organic solvent is appropriately selected depending on the intended purpose without any restriction, but it is preferably an organic solvent having a boiling point lower than 150° C. as it is easily removed.

The organic solvent having a boiling point lower than 150° C. is appropriately selected depending on the intended purpose without any restriction. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination.

Among them, ethyl acetate, toluene, xylene, benzene, methylene chloride, 1,2-dichloroethane, chloroform, and carbon tetrachloride are preferable, and ethyl acetate is more preferable.

—Emulsification and/or Dispersion—

The emulsification and/or dispersion of the toner material can be performed by dispersing the oil phase containing the toner material in the aqueous medium. At the time when the toner material is emulsified and/or dispersed, an adhesive based is generated by reacting the reactive precursor with the curing agent to proceed to an elongation reaction and/or crosslink reaction.

Examples of the adhesive base include the first non-crystalline polyester resin. Examples of the curing agent include the amine compound. Examples of the reactive precursor include an isocyanate group-containing non-crystalline polyester resin.

The adhesive base can be generated, for example, by emulsifying or dispersing in an aqueous medium an oil phase containing a polymer reactive with an active hydrogen group, such as polyester prepolymer containing an isocyanate group, together with a compound containing an active hydrogen group, such as amines; and allowing the compound containing the active hydrogen group and the polymer reactive with an active hydrogen group to react to proceed an elongation reaction and/or crosslink reaction. Moreover, the adhesive base may be generated by emulsifying or dispersing, in an aqueous medium to which a compound containing an active hydrogen group has been added in advance, an oil phase containing the toner material, to thereby proceed to an elongation reaction and/or a crosslink reaction. Alternatively, the adhesive base can be generated by, after emulsifying or dispersing an oil phase containing a toner material in an aqueous medium, adding a compound containing an active hydrogen group thereto, and initiating an elongation reaction and/or crosslink reaction at an interface of a particle. Note that, in the case where the elongation reaction and/or crosslink reaction thereof is initiated at an interface of a particle, a urethane- and/or urea-modified polyester resin is preferentially generated on a surface of a toner base particle to be formed, so that it is possible to give a concentration deviation of the urethane- and/or urea-modified polyester resin within the toner particle.

The reaction conditions (e.g. reaction duration and reaction temperature) for generating the adhesive base are not particularly restricted, and are appropriately selected depending on the combination of the compound containing an active hydrogen group, and the polymer having a site reactive with the compound containing an active hydrogen group.

The reaction duration is appropriately selected depending on the intended purpose without any restriction, but it is preferably 10 minutes to 40 hours, more preferably 2 hours to 24 hours.

The reaction temperature is appropriately selected depending on the intended purpose without any restriction, but it is preferably 0° C. to 150° C., more preferably 40° C. to 98° C.

A method for stably forming a dispersion liquid containing a compound containing an active hydrogen group (e.g., polyester prepolymer containing an isocyanate group) and a polymer having a site reactive with the compound containing an active hydrogen group is appropriately selected depending on the intended purpose without any limitation, and examples thereof include a method, in which an oil phase prepared by dissolving and/or dispersing a toner material in a solvent is added to an aqueous medium, and dispersing the oil phase therein by shear force.

A disperser used for the dispersing is appropriately selected depending on the intended purpose without any restriction. Examples thereof include a low-speed shearing disperser, a high-speed shearing disperser, a friction disperser, a high-pressure jetting disperser and ultrasonic wave disperser.

Among them, the high-speed shearing disperser is preferable as it enables to control the diameters of the resulting dispersed elements in a range of 2 μm to 20 μm.

In use of the high-speed shearing disperser, the conditions such as the rotating speed, dispersion duration, and dispersion temperature are appropriately selected depending on the intended purpose without any restriction.

The rotating speed is appropriately selected depending on the intended purpose without any restriction, but it is preferably 1,000 rpm to 30,000 rpm, more preferably 5,000 rpm to 20,000 rpm.

The dispersion duration is appropriately selected depending on the intended purpose without any restriction. In the case of a batch system, the duration is preferably 0.1 minutes to 5 minutes.

The dispersion temperature is appropriately selected depending on the intended purpose without any restriction. The dispersion temperature is preferably 0° C. to 150° C., more preferably 40° C. to 98° C. in a pressurized state. Note that, the higher dispersion temperature generally makes dispersion easier.

An amount of the aqueous medium for use at the time when the toner material is emulsified and/or dispersed is appropriately selected depending on the intended purpose without any restriction. The amount thereof is preferably 50 parts by mass to 2,000 parts by mass, more preferably 100 parts by mass to 1,000 parts by mass, relative to 100 parts by mass of the toner material.

When the amount of the aqueous medium is smaller than 50 parts by mass, the toner material may not be in a desirable dispersed state, and thus toner base particles of the predetermined particle diameters may not be obtained. When the amount thereof is larger than 2,000 parts by mass, the production cost increases.

It is preferred that a dispersant be used during emulsification and/or dispersion of the oil phase containing the toner material for stabilizing dispersed elements such as oil droplets, forming the dispersed elements into the predetermined shapes, and giving a sharp particle size distribution thereof.

The dispersant is appropriately selected depending on the intended purpose without any restriction. Examples thereof include a surfactant, a poorly water-soluble inorganic dispersant, and a polymer protective colloid. These may be used alone or in combination.

Among them, a surfactant is preferable.

The surfactant is appropriately selected depending on the intended purpose without any restriction. Examples thereof include an anionic surfactant, a cationic surfactant, a nonionic surfactant, and an amphitricha surfactant.

The anionic surfactant is appropriately selected depending on the intended purpose without any restriction. Examples thereof include alkylbenzenesulfonic acid salts, α-olefin sulfonic acid salts and phosphoric acid esters.

Among them, those containing a fluoroalkyl group are preferable.

A catalyst is optionally used in an elongation reaction and/or crosslink reaction for generating the adhesive base.

The catalyst is appropriately selected depending on the intended purpose without any restriction. Examples thereof include dibutyl tin laurate, and dioctyl tin laurate.

—Removal of Organic Solvent—

A method for removing the organic solvent from the dispersion liquid such as an emulsified slurry is appropriately selected depending on the intended purpose without any restriction. Examples of such a method include: a method where a temperature of an entire system is gradually increased to evaporate the organic solvent contained in the oil droplets; and a method where the dispersion liquid is sprayed in a dry atmosphere to remove the organic solvent in the oil droplets.

Once the organic solvent is removed, toner base particles are formed. The toner base particles can be subjected to washing, drying, and the like, and may be further subjected to classification. The classifying can be performed by removing the fine particles component by means of a cyclone, a decanter, a centrifugal separator, or the like. Alternatively, the classification can be performed after drying the toner base particles.

The obtained toner base particles may be mixed with particles such as the aforementioned external additives, charge controlling agent, and the like. During the mixing, a mechanical impact may be applied so that the particles such as the external additives are prevented from dropping off from the surfaces of the toner base particles.

A method for applying the mechanical impact is appropriately selected depending on the intended purpose without any restriction. Examples thereof include a method in which an impact is applied to a mixture using a high-speed rotating blade, and a method in which an impact is applied by putting mixed particles into a high-speed air flow and accelerating the air speed so that the particles collide against one another or that the particles are crashed into a proper collision plate.

A device used in the aforementioned method is appropriately selected depending on the intended purpose without any restriction. Examples thereof include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

(Developer)

The developer of the present invention contains at least the toner, and may further contain a carrier, and other components, if necessary.

Accordingly, the developer has excellent transfer properties, and charging ability, and can stably form high quality images. Note that, the developer may be a one-component developer, or two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is balanced, namely, the toner is supplied to the developer, and consumed by developing, the toner does not cause filming to a developing roller, nor fuse to a layer thickness regulating member such as a blade for thinning a thickness of a layer of the toner, and provides excellent and stable developing ability and image even when it is stirred in the developing unit over a long period of time.

In the case where the developer is used as a two-component developer, the diameters of the toner particles in the developer do not vary largely even when the toner is balanced, and the toner can provide excellent and stabile developing ability even when the toner is stirred in the developing unit over a long period of time.

In the case where the toner is used for a two-component developer, the toner can be mixed with the carrier. An amount of the carrier in the two-component developer is appropriately selected depending on the intended purpose without any limitation, but it is preferably 90% by mass to 98% by mass, more preferably 93% by mass to 97% by mass.

<Carrier>

The carrier is appropriately selected depending on the intended purpose without any restriction, but it is preferably a carrier containing a core, and a resin layer coating the core.

—Core—

A material of the core is appropriately selected depending on the intended purpose without any restriction, and is preferably, for example, selected from a manganese-strontium (Mn—Sr) based material of 50 emu/g to 90 emu/g, a manganese-magnesium (Mn—Mg) based material of 50 emu/g to 90 emu/g. In order to attain secure a sufficient image density, use of a high magnetic material, such as iron powder (100 emu/g or higher) and magnetite (75 emu/g to 120 emu/g), is preferable. Moreover, a weak magnetic material such as a cupper-zinc (Cu—Zn) based material (30 emu/g to 80 emu/g) is preferable because the resulting carrier enables to reduce the impact of the toner brush onto a photoconductor, and therefore it is advantageous for forming high quality images.

These may be used alone or in combination.

The volume average particle diameter of the cores is appropriately selected depending on the intended purpose without any limitation, but it is preferably 10 μm to 150 μm, more preferably 40 μm to 100 μm. When the volume average particle diameter is smaller than 10 μm, a proportion of fine particles in the carrier increases, and magnetic force per particle reduces, which may cause scattering of the carrier. When the volume average particle diameter thereof is greater than 150 μm, specific surface area thereof decreases, and therefore scattering of a toner may be caused. Especially in the case of a full color image having a large area of a solid image, reproducibility of the solid area may be impaired.

(Image Forming Method and Image Forming Apparatus)

The image forming method of the present invention contains at least a charging step, an exposing step, a developing step, a primary transferring step, a secondary transferring step, a fixing step, and a cleaning step, and may further contain other steps, if necessary.

The image forming apparatus of the present invention contains at least a charging unit, an exposing unit, a developing unit, a primary transferring unit, a secondary transferring unit, a fixing unit, and a cleaning unit, and may further contain other units, if necessary.

The charging step is charging an electrophotographic photoconductor (may be referred to as a "photoconductor" hereinafter).

The exposing step is forming a latent electrostatic image on the charged electrophotographic photoconductor.

The developing step is developing the latent electrostatic image with a toner to form a toner image on the electrophotographic photoconductor.

The primary transferring step is transferring the toner image formed on the electrophotographic photoconductor to an intermediate transfer member.

The secondary transferring step is transferring the toner image transferred on the intermediate member to a recording medium.

The fixing step is fixing the toner image, which has been transferred on the recording medium, onto the recording medium.

The cleaning step is cleaning the residual toner remained on a surface of the electrophotographic photoconductor after the primary transferring step.

The charging unit is a unit configured to charge an electrophotographic photoconductor.

The exposing unit is a unit configured to form a latent electrostatic image on the charged electrophotographic photoconductor.

The developing unit is a unit configured to develop the latent electrostatic image with a toner to form a toner image on the electrophotographic photoconductor.

The primary transferring unit is a unit configured to transfer the toner image formed on the electrophotographic photoconductor to an intermediate transfer member.

The secondary transferring unit is a unit configured to transfer the toner image transferred to the intermediate transfer member to a recording medium.

The fixing unit is a unit configured to fix the toner image, which has been transferred to the recording medium, onto the recording medium.

The cleaning unit is a unit configured to clean the toner remained on a surface of the electrophotographic photoconductor.

The image forming method is suitably performed by the image forming apparatus. The charging step is suitably performed by the charging unit, the exposing step is suitably performed by the exposing unit, the developing step is suitably performed by the developing unit, the primary transferring step is suitably performed by the primary transferring unit, the secondary transferring step is suitably performed by the secondary transferring unit, the fixing step is suitably performed by the fixing unit, the cleaning step is suitably performed by the cleaning unit, and the aforementioned other steps are suitably performed by the aforementioned other units.

The toner is the toner of the present invention.

In the secondary transferring step, it is preferred that a linear speed of the transfer of the toner image to the recording medium be 100 mm/sec to 1,000 mm/sec, and the transfer duration at the nip be 0.5 msec to 60 msec.

The image forming method preferably employs a tandem electrophotographic image forming process.

Figure 2:
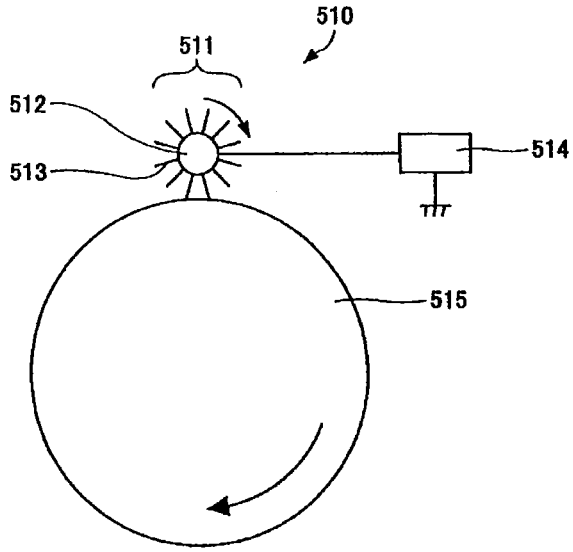
FIG. 2 is a schematic diagram illustrating one example of a contact brush charging device.

As for a charging device (the charging unit) used in the image forming method and image forming apparatus, for example, contact charging devices illustrated in FIGS. 1 and 2 can be used.

<Roller Charging Device>

A schematic structure of one example of a roller charging device 500, which is a type of a contact charging device, is illustrated in FIG. 1. The photoconductor 505, which is an image bearing member to be charged, is rotationally driven in the direction depicted with the arrow at the predetermined speed (process speed). The charging roller 501, which is a charging unit provided in contact with the photoconductor 505, contains, as a basic structure, a core metal 502, and an electric conductive rubber layer 503, which is formed on the outer surface of the core metal 502 in the form of a concentric roller. The both ends of the core metal 502 are rotatably supported with axis receiving members, which are not illustrated. Moreover, the core metal 502 is pressed against the photoconductor 505 at certain pressing force by a pressurizing unit (not illustrated). The charging roller 501 is rotated along the rotation of the photoconductor 505. The charging roller 501 is formed by coating the core metal 502 having a diameter of 9 mm with the electric conductive rubber layer 503 having intermediate resistance of about 100,000 Ω·cm to give a diameter of 16 mm to the charging roller 501. The core metal 502 of the charging roller 501 and the power source 504 are electrically connected, and the predetermined bias is applied to the charging roller 501 from the power source 504. As a result, the outer surface of the photoconductor 505 is uniformly charged with predetermined polarity and potential.

<Fur Brush Charging Device>

An embodiment of the charging device for use in the present invention may be, other than the roller charging device, any of a magnetic brush charging device, or a fur brush charging device, and the embodiment thereof can be selected depending on the specification or embodiment of the electrophotographic device. In case of the magnetic brush charging device, the magnetic brush uses, for example, various ferrite particles, such as Zn—Cu ferrite, as a charging member, and the magnetic brush charging device contains a non-magnetic electric conductive sleeve configured to support the magnetic brush, and a magnet roll provided inside and covered with the electric conductive sleeve. In case of the fur brush charging device, examples of a material of the fur brush include fur which has been subjected an electric conduction treatment using carbon, copper sulfide, metal or metal oxide. The treated fur is wound around a core metal formed of a metal, or other electric conduction treated materials to form a charging device.

One example of the schematic structure of the contact fur brush charging device 510 is depicted in FIG. 2. The photoconductor 515, which is an image bearing member to be charged, is driven to rotate in the direction shown with the arrow at the predetermined speed (process speed). The far brush roller 511 composed of a fur brush is brought into contact with the photoconductor 515 with the predetermined nip with the pressing force against elasticity of the brush part 513.

The fur brush 511 as a contact charging device in this example is, for example, a roll brush having an outer diameter of 14 mm and a longer-direction length of 250 mm, formed by spirally winding a tape, which is a terry of electroconductive rayon fibers REC-B manufactured by UNITIKA LTD. as a brush part 513 around a metal core 512 having a diameter of 6 mm also serving as an electrode. The brush of the brush part 513 is, for example, 300 denier/50 filaments, and has a density of 155 filaments/$mm^2$. This roll brush is inserted into a pipe having an inner diameter of 12 mm with rotating one direction, and is designed to be concentric to the pipe. Then, the roll brush is left to stand in high temperature high humidity atmosphere to make the fibers slanted.

The resistance of the fur brush roller 511 is $1\times10^5\Omega$ with the applied voltage of 100V. The resistance is determined by converting the electric current passed through when the fur brush roller is earthed to a metal drub having a diameter of 30 mm with a nip width of 3 mm, and voltage of 100V is applied. The resistance of the brush charging device 510 needs to be $10^4\Omega$ or greater, in order to prevent image failures, which is caused due to a charging failure at a charging nip, which is caused by excessive leak current run into the low pressure resistant defects, such as pin holes, formed on the photoconductor 515 to be charged. Moreover, in order to sufficiently inject charge into the surface of the photoconductor 515, the resistance needs to be $10^7\Omega$ or less.

Examples of the material of the brush include, other than REC-B manufactured by UNITIKA LTD., REC-C, REC-M1, and REC-M10 of UNITIKA LTD., SA-7 of Toray Industries, Inc., Thunderon of Nihon Sanmo Dyeing Co., Ltd., Belltron of KB seiren, Kuracarb of KURARY CO., LTD., a material in which carbon is dispersed in rayon, and Royal of Mitsubishi Rayon Co., Ltd. It is preferred that each fiber of the brush be 3 denier to 10 denier, and the brush fibers have 10 filaments/bundle to 100 filaments/bundle, and the brush have a density of 80 filaments/$mm^2$ to 600 filaments/$mm^2$. The length of the fiber is preferably 1 mm to 10 mm.

The fur brush roller 511 is driven to rotate in the counter direction to the rotational direction of the photoconductor 515 at the predetermined peripheral velocity (speed of the surface), and is brought into contact with the surface of the photoconductor with a difference in the rotational speed. Then, the predetermined charging voltage is applied to the brush roller 511 from the power source 514, to thereby give the predetermined polarity and uniform potential to the surface of the rotating photoconductor in a contact manner.

In this example, contact charging of the photoconductor 515 by the fur brush 511 is dominantly performed with direct injection of charge, and the surface of the rotating photoconductor is charged to the potential, which is substantially the same to the applied charging voltage to the fur brush roller 511.

An embodiment of the charging member (charging unit) for use in the present invention may be, other than the fur brush roller 511, any embodiment, such as a charging roller, and a fur brush, which is selected depending on the specification or embodiment of the electrophotographic device. In case of the charging roller, it is common that the charging roller contain a core, and a rubber layer having an intermediate resistance of about 100,000 Ω·cm, and covering the core. In case of the magnetic brush, the magnetic brush uses, for example, various ferrite particles, such as Zn—Cu ferrite, as a charging member, and the magnetic brush charging device contains a non-magnetic electric conductive sleeve configured to support the magnetic brush, and a magnet roll provided inside and covered with the electric conductive sleeve.

As for the magnetic brush as the contact charging member in this example, for example, usable is coated magnetic particles prepared by mixing Zn—Cu ferrite particles having the average particle diameter of 25 μm and Zn—Cu ferrite particles having the average particle diameter of 10 μm at a mass ratio of 1:0.05, and coating the ferrite particles having the average particle diameter of 25 μm and having peaks at the aforementioned average particle diameters, with an intermediate resistance resin layer. The contact charging member is composed of, for example, the aforementioned coated magnetic particles, a non-magnetic electric conductive sleeve configured to support the coated magnetic particles, and a magnet roll provided inside the electric conductive sleeve. The coated magnetic particles are coated on the sleeve to give a thickness of 1 mm, to thereby form a charging nip having a width of about 5 mm to the photoconductor. Moreover, a space between the magnetic particle bearing sleeve and the photoconductor is, for example, about 500 μm. Moreover, the magnetic roll is rotated in the opposite direction to the rotational direction of the photoconductor in the manner that the surface of the sleeve is rubbed against the surface of the photoconductor twice the speed of the peripheral velocity of the photoconductor surface. As a result, the photoconductor and the magnetic brush are uniformly brought into contact with each other.

Figure 3:
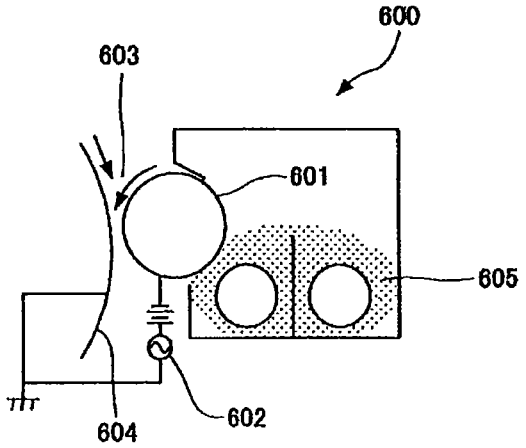
FIG. 3 is a schematic diagram illustrating one example of a developing unit.

When a latent electrostatic image of the photoconductor is developed, alternating electric field is preferably applied. In the developing device (developing unit) 600 illustrated in FIG. 3, oscillation bias voltage, in which AC voltage is overlapped with DC voltage, is applied as developing bias to the developing sleeve 601 from the power source 602 during the developing. The potential of the back ground and the potential of the image area are between the maximum value and the minimum value of the oscillation bias potential. In this manner, the alternating electric field, whose direction is alternately changed, is formed at the developing device 603. In this alternating electric field, the toner and carrier of the developer are intensely oscillated so that the toner 605 jumps to the photoconductor 604 with beating the electrostatic force to the developing sleeve 601 and the carrier. Then, the toner is deposited on the photoconductor 604 corresponding to a latent electrostatic image. Note that, the toner 605 is the aforementioned toner of the present invention.

The difference between the maximum value and the minimum value (peak-to-peak voltage) of the oscillation bias voltage is preferably 0.5 kV to 5 kV, and the frequency thereof is preferably 1 kHz to 10 kHz. The wave form of the oscillation bias voltage may be square wave, sine wave, or triangular wave. The DC voltage component of the oscillation bias is the value between the potential of the back ground and the potential of the image area, and it is preferably the value closer to the potential of the back ground than the potential of the image area in order to prevent the deposition of the toner on the back ground potential area.

In the case where the wave form of the oscillation bias voltage is square wave, the duty ratio is preferably 50% or lower. The duty ratio is a ratio of the time for the toner to traveling to the photoconductor in one cycle of the oscillation bias. By setting the duty ratio in the aforementioned manner, a difference between the peak value and the average value of the time of the bias when the toner travels to the photoconductor can be increased. Therefore, the movement of the toner is enhanced, so that the toner is accurately deposited in accordance with the potential distribution on the latent image surface and texture and resolution of the image can be improved. Moreover, a difference between the peak value and the average value of the bias for the carrier, which has a reverse polarity to that of the toner, to travel to the photoconductor is reduced, and therefore the movement of the carrier is subsided, and a possibility of the carrier to deposit on the back ground of the latent image can be significantly reduced.

Figure 4:
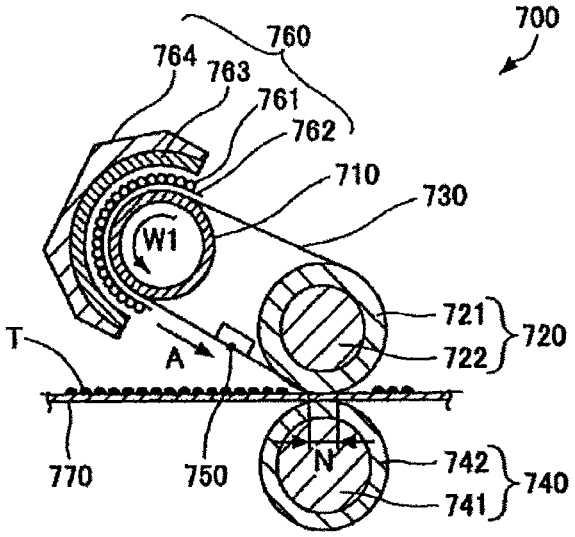
FIG. 4 is a schematic diagram illustrating one example of a fixing device.

As for the fixing device (fixing unit) for use in the image forming method, for example, a fixing device illustrated in FIG. 4 can be used. The fixing device 700 illustrated in FIG. 4 contain a heating roller 710 which is heated by electromagnetic induction by means of an induction heating unit 760, a fixing roller 720 (a counter roller) provided parallel to the heating roller 710, an endless belt fixing belt (heat resistant belt, toner heating medium) 730, which is supported with the heating roller 710 and the fixing roller 720, is heated by the heating roller 710, and is rotated in the arrow A direction by the rotation of at least one of these rollers, and a pressurizing roller 740 (pressure roller) brought into contact with the fixing roller 720 via the fixing belt 730 with a certain pressure, and is rotated in the same direction to the rotation of the fixing belt 730.

The heating roller 710 is composed of a hollow cylindrical magnetic metal member, which is formed of, for example, iron, cobalt, nickel, or an alloy of these metals, has an outer diameter of, for example, 20 mm to 40 mm, and a radial thickness of, for example, 0.3 mm to 1.0 mm, so that the heating roller 710 has a structure having low thermal capacity and capable of increasing the temperature thereof promptly.

The fixing roller 720 (counter roller) is, for example, composed of a core metal 721 formed of a metal such as stainless steel, and an elastic member 722, which covers the core meal 721 and is formed of solid or foam thermal resistant silicone rubber. Moreover, the outer diameter of the fixing roller 720 is adjusted to about 20 mm to 40 about mm, which is larger than the heating roller 710, in order to form a certain width of a contacting area between the pressurizing roller 740 and the fixing roller 720 by the pressing force from the pressurizing roller 740. The radial thickness of the elastic member 722 is about 4 mm to about 6 mm. As a result of this structure, the thermal capacity of the heating roller 710 becomes smaller than that of the fixing roller 720, and therefore the heating roller 710 is rapidly heated to thereby reduce warm-up time.

The fixing belt 730 supported with the heating roller 710 and the fixing roller 720 is heated at a contact area W1 with the heating roller 710 heated by the induction heating unit 760. Then, the inner surface of the fixing belt 730 is continuously heated by the rotations of the heating roller 710 and the fixing roller 720. As a result, the entire belt is heated.

Figure 5:
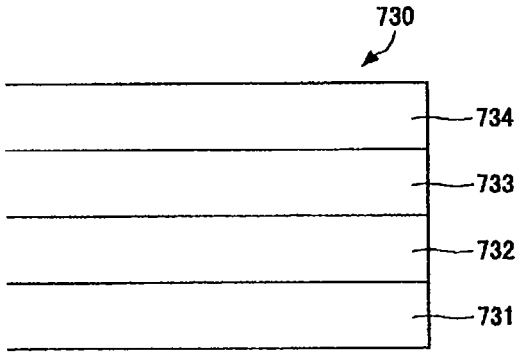
FIG. 5 is a schematic diagram illustrating a layer structure of a fixing belt.

A layer structure of the fixing belt 730 is depicted in FIG. 5. The structure of the fixing belt 730 contains the following four layers from the inner layer to the surface layer.

- Base 731: a resin layer formed of polyimide (PI) resin or the like
- Heat generating layer 732: an electroconductive material layer, formed of Ni, Ag, SUS, or the like
- Intermediate layer 733: an elastic layer for achieving uniform fixing
- Releasing layer 734: a resin layer formed of a fluororesin material or the like, for achieving a releasing effect and oil-less fixing A thickness of the releasing layer 734 is desirably about 10 μm to about 300 μm, especially desirably about 200 μm. In the fixing device 700 illustrated in FIG. 4, the releasing layer 734 with such thickness, serving as a surface layer of the fixing belt 730, can sufficiently cover a toner layer (T) formed on the recording medium 770 corresponding to its shape, and therefore, the toner image (T) can be uniformly heated and melted. In order to maintain abrasion resistance of the surface releasing layer over time, the thickness of the releasing layer 734 needs to be 10 μm at the minimum. When the thickness of the releasing layer 734 is greater than 300 μm, a thermal capacity of the fixing belt 730 increases, and therefore the time required for warming up becomes long. Moreover, the surface temperature of the fixing belt 730 is difficult to be decreased during the fixing step, an effect of aggregating melted toner particles cannot attained at an outlet of the fixing unit, and the releasing properties of the fixing belt 730 is decreased. As a result, the toner of the toner image (T) is adhered to the fixing belt 730 to thereby cause, so-called hot offset. Note that, as the base of the fixing belt 730, the heat generating layer 732 formed of a metal may be used, or a resin layer having thermal resistance, such as a fluororesin, a polyimide resin, polyamide resin, a polyamide imide resin, a PEEK resin, a PES resin, and a PPS resin, may be used.

The heating roller 740 contains, for example, a core metal 741 formed of a metal cylindrical material having high thermal conductivity, such as cupper and aluminum, and an elastic member 742 having high thermal resistance and toner releasing properties, and provided on the surface of the core metal 741. As for the core metal 741, other than the aforementioned metals, SUS may be used. The pressurizing roller 740 is pressed against the fixing roller 720 via the fixing belt 730 to form a fixing nip (N). In the present embodiment, the pressurizing roller 740 is penetrated into the fixing roller 720 (and the fixing belt 730) by adjusting the hardness of the pressurizing roller 740 to be higher than that of the fixing roller 720. Because of this penetration, the recording medium 770 travels along the cylindrical shape of the surface of the pressurizing roller 740, and therefore the recording medium 770 is easily released from the surface of the fixing belt 730. The outer diameter of the pressurizing roller 740 is similar to that of the fixing roller 720, and is about 20 mm to about 40 mm, but the radial thickness thereof is about 0.5 mm to about 2.0 mm, which is thinner than that of the fixing roller 720.

The induction heating unit 760 configured to heat the heating roller 710 by electromagnetic induction contains, as illustrated in FIG. 4, an excitation coil 761, which is a magnetic field generating unit, and a coil guide plate 762 around which the excitation coil 761 is wound. The coil guide plate 762 is provided closely to the outer surface of the heating roller 710 and has a semi-cylindrical shape. The excitation coil 761 is one long excitation coil wire alternately wound with respect to the axial direction of the heating roller 710 along the coil guide plate 762. Note that, the excitation coil 761 is connected to a driving power source (not illustrated) in which frequency of an oscillation circuit is variable. At the outer side of the excitation coil 761, a semi-cylindrical excitation coil core 763, which is formed of a ferromagnetic material, such as ferrite, is fixed with an excitation coil core supporting member 764, and is provided adjacent to the excitation coil 761.

(Process Cartridge)

The process cartridge for use in the present invention contain at least an electrophotographic photoconductor, and a developing unit, selected from units of an image forming apparatus, which contains the electrophotographic photoconductor, a charging unit configured to charge the electrophotographic photoconductor, an exposing unit configured to expose the charged electrophotographic photoconductor to light to form a latent electrostatic image on the electrophotographic photoconductor, the developing unit configured to develop the latent electrostatic image formed on the electrophotographic photoconductor with a toner to form a toner image, a transferring unit configured to transfer the toner image formed on the electrophotographic photoconductor to a recording medium with or without transferring through an intermediate transfer member, a fixing unit configured to fix the transferred toner image on the recording medium, and a cleaning unit configured to clean the residual toner deposited on the surface of the electrophotographic photoconductor after transferring the toner image to the intermediate transfer member or the recording medium by the transferring unit. The process cartridge contains the aforementioned units supported integrally and is detachably mounted in a main body of an image forming apparatus. Moreover, the developing unit contains the toner of the present invention. As for the developing unit and charging unit, the aforementioned developing device and charging device are suitably used.

Figure 6:
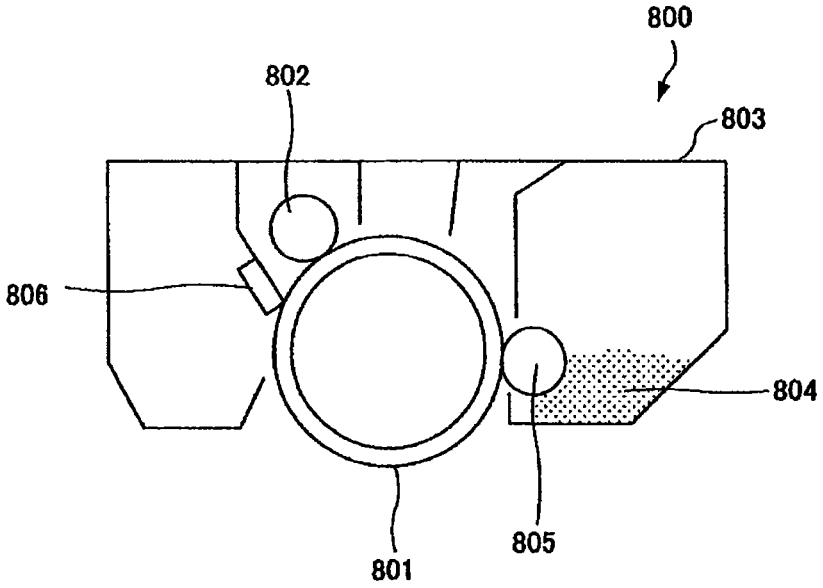
FIG. 6 is a schematic diagram illustrating one example of a process cartridge associated with the present invention.

An example of the process cartridge for use in the present invention is illustrated in FIG. 6. The process cartridge 800 illustrated in FIG. 6 contains a photoconductor 801, a charging unit 802, a developing unit 803, and a cleaning unit 806. The operation of this process cartridge 800 is explained. The photoconductor 801 is rotationally driven at a certain circumferential speed. During the rotation of the photoconductor 801, a circumferential surface of the photoconductor 801 is uniformly charged positively or negatively at the predetermined potential by the charging unit 802. Next, imagewise light is applied from an image exposing unit, which is not illustrated, such as slit exposure and laser beam scanning exposure. In this manner latent electrostatic images are sequentially formed on the circumferential surface of the photoconductor 801. The formed latent electrostatic image is then visualized with a toner 804 by means of the developing unit 803 to form a toner image. The developed toner images are substantially transferred by a transferring unit, which is not illustrated, onto a recording medium, synchronized to the rotation of the photoconductor 801 and fed from a paper feeding part to between the photoconductor 801 and the transferring unit. The recording medium on which the image have been transferred is separated from the surface of the photoconductor, and guided to an image fixing unit, which is not illustrated, to thereby fix the image. Then the resultant is discharged as a printed out copy. The surface of the photoconductor 801 after the image transfer is cleaned by the cleaning unit 806 to remove the residual toner thereon, and diselectrified. Thereafter, the photoconductor 801 is used again for image formation.

Figure 7:
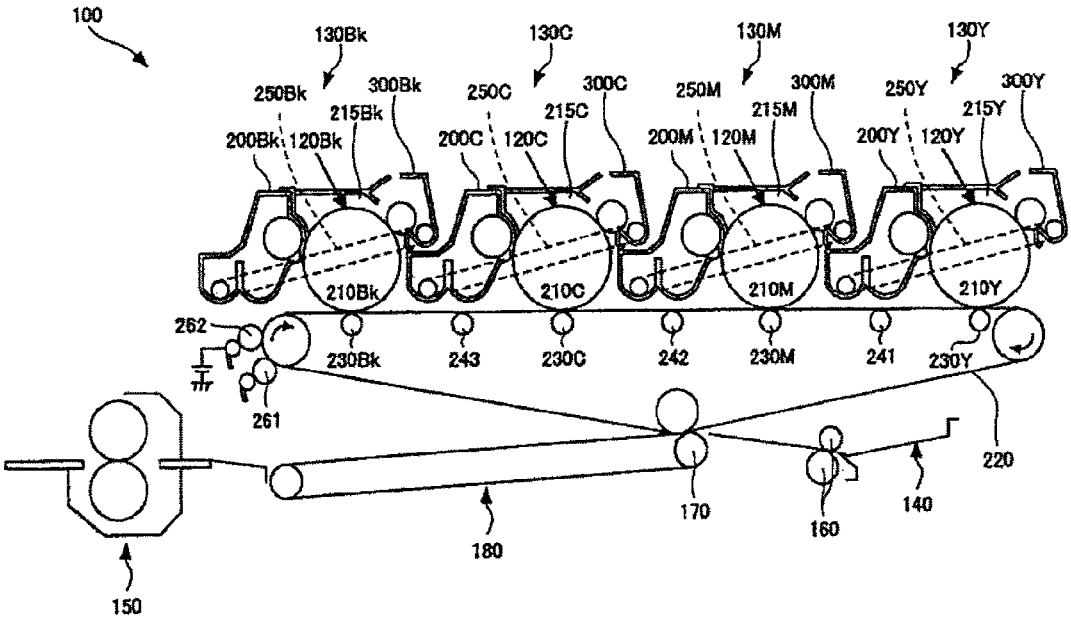
FIG. 7 is a schematic diagram illustrating one example of an image forming device associated with the present invention.
Figure 8:
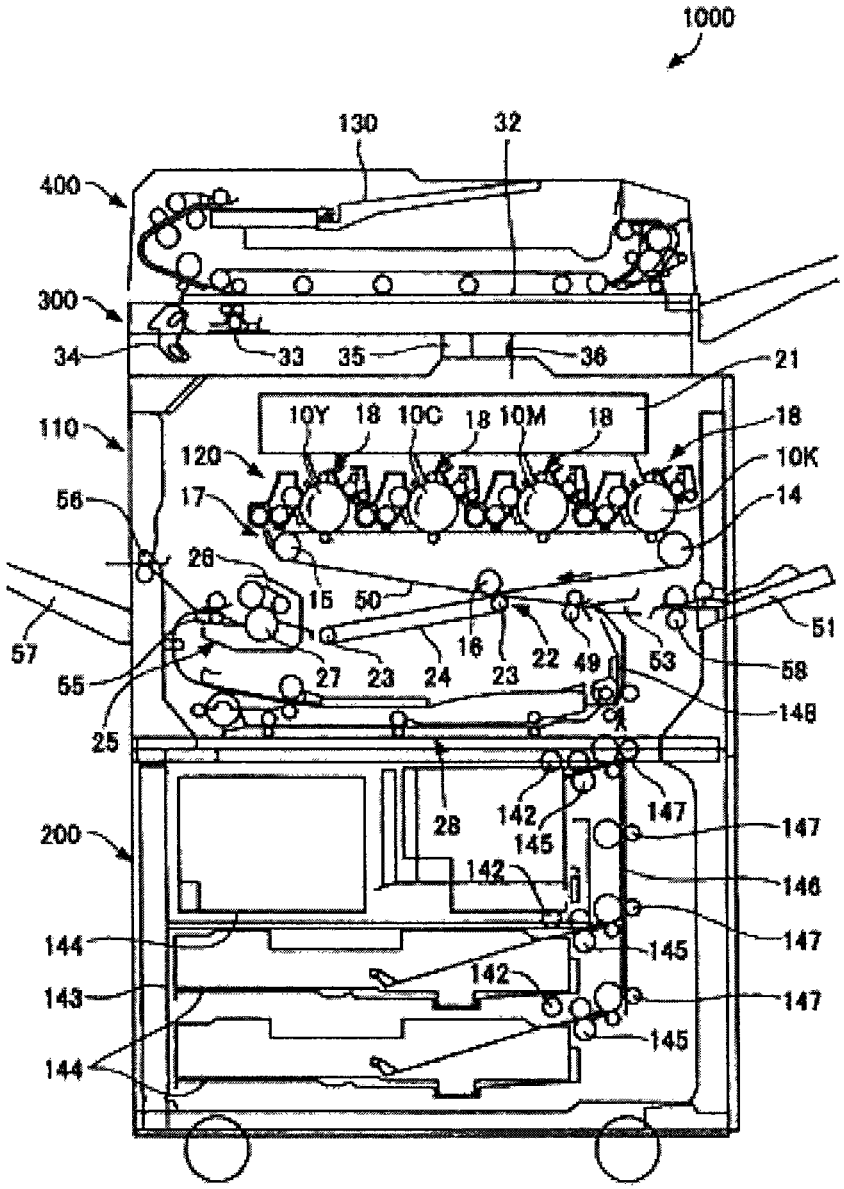
FIG. 8 is a schematic diagram illustrating another example of an image forming device associated with the present invention.

As for an image forming device used in the image forming method of the present invention, for example, a tandem image forming apparatus 100 illustrated in FIGS. 7 and 8 can be used. In FIG. 7, the image forming apparatus 100 is mainly composed of image writing units (120Bk, 120C, 120M, 120Y), image forming untis (130Bk, 130C, 130M, 130Y), and a paper feeding unit 140, which are for performing color image formation by an electrophotographic process. Image processing is carried out by an image processing unit (not illustrated) based on image signals, to convert to signals of each color, black (Bk), cyan (C), magenta (M), yellow (Y) for image forming, which are transmitted to the image writing units (120Bk, 120C, 120M, 120Y). The image writing units (120Bk, 120C, 120M, 120Y) are, for example, laser scanning optics, composed of a laser source, a polarizer such as a polygonal rotating mirror, a scanning imaging optics, and a group of mirrors (any of these are not illustrated). The image writing units (120Bk, 120C, 120M, 120Y) give four wiring light paths corresponding the aforementioned signals of each color, to write respective images corresponding the aforementioned signals on the image forming units (130Bk, 130C, 130M, 130Y).

The image forming units (130Bk, 130C, 130M, 130Y) are each equipped with a respective photoconductor (210Bk, 210C, 210M, 210Y) for black, cyan, magenta, or yellow. As for these photoconductors (210Bk, 210C, 210M, 210Y), an OPC photoconductor is typically used. In the surrounding area of each photoconductor (210Bk, 210C, 210M, 210Y), a charging device (215Bk, 215C, 215M, 215Y), an exposing unit configured to expose to laser light emitted from the image writing unit (120Bk, 120C, 120M, 120Y), a developing device (200Bk, 200C, 200M, 200Y) for a respective color, a primary transferring device (230Bk, 230C, 230M, 230Y), a cleaning device (300Bk, 300C, 300M, 300Y), and a diselectrification device (not illustrated) are provided. Note that, the developing device (200Bk, 200C, 200M, 200Y) employs a two-component magnetic brush developing system. Moreover, an intermediate transfer belt 220 is provided between each photoconductor (210Bk, 210C, 210M, 210Y) and primary transferring device (230Bk, 230C, 230M, 230Y) to successively transfer and superimpose a toner image of each color from each photoconductor onto the intermediate transfer belt 220, so that the intermediate transfer belt 220 bears the toner images from all of the photoconductors.

In some cases, a pre-transfer charger is provided outside the intermediate transfer belt 220 at the position after passing through the primary transfer position of the final color, and before passing through the secondary transfer position. The pre-transfer charger is to uniformly charge the toner image, which is on the intermediate transfer belt 220 transferred from the photoconductor 210 by the primary transferring unit, to have the identical polarity before being transferred to transfer paper serving as a recording medium.

The toner image transferred on the intermediate transfer belt 220 from each photoconductor (210Bk, 210C, 210M, 210Y) may contain both a half-tone area and a solid area, or an area having a different amount of the toner superimposed. Therefore, the charged amount may be varied in the toner image. Moreover, there are cases where the charge amount is varied in the toner image on the intermediate transfer belt 220 after the primary transferring because of release discharging caused in a space located adjacent to and downstream of the primary transferring unit in the traveling direction of the intermediate transfer belt. Such variation in the charged amount within the same toner image may restrict a transfer margin for the secondary transferring unit at which the toner image on the intermediate transfer belt 220 is transferred to transfer paper. Accordingly, the toner image is uniformly charged to the identical polarity to that of the toner image by the pre-transfer charger so that the variation in the charged amount within the same toner image can be eliminated, and the transfer margin for the secondary transferring unit can be improved.

In accordance with the image forming method described above, transfer properties at the secondary transferring unit can be made almost constant in any area of the toner image on the intermediate transfer belt 220, even when there is a variation in the charged amount within the toner image on the intermediate transfer belt, by uniformly charging the toner image transferred from each photoconductor (210Bk, 210C, 210M, 210Y) onto the intermediate transfer belt 220. Accordingly, the reduction in the transfer margin at the time of transferring to transfer paper is inhibited, so that the toner image can be stably transferred.

Note that, in this image forming method, the charged amount of the toner image charged by the pre-transfer charger varied depending on the traveling speed of the intermediate transfer belt 220, which is a subject for charging. For example, if the traveling speed of the intermediate transfer belt 220 is slow, the time required for the one area of the toner image on the intermediate transfer belt 220 to pass through the charging region by the pre-transfer charger becomes long, and therefore the charged amount is large. On the other hand, when the traveling speed of the intermediate transfer belt 220 is fast, the charged amount of the toner image on the intermediate transfer belt 220 is small. Therefore, in the case where the traveling speed of the intermediate transfer belt 220 changes during the period when the toner image on the intermediate transfer belt 220 passes through the charging position by the pre-transfer charger, it is preferred that the pre-transfer charger be controlled corresponding to the traveling speed of the intermediate transfer belt 220, so as not to vary the charging amount to the toner image.

In between the primary transferring devices (230Bk, 230C, 230M, 230Y), electric conductive rollers 241, 242, 243 are provided. After the transfer paper is fed from the paper feeder 140, the transfer paper is carried on the transfer belt 500 via a pair of the registration rollers 160, and the toner image on the intermediate transfer belt 220 is transferred onto the transfer paper by the secondary transfer roller 170 at the position where the intermediate transfer belt 220 and the secondary transfer belt 180 are brought into contact with each other, to thereby perform color image formation.

Then, the transfer paper on which the image has been formed is transported to the fixing device 150 by the secondary transfer belt 180, and the image is fixed to output a color image. The toner remained on the intermediate transfer belt 220 without being transferred is removed from the belt by the intermediate transfer belt cleaning device.

The polarity of the toner on the intermediate transfer belt 220 before being transferred to the transfer paper is negative, which is identical to the polarity thereof at the time of the developing, and therefore a positive transfer bias voltage is applied to the secondary transfer roller 170 to transfer the toner on the transfer paper. The nip pressure here affects the transfer properties, which then largely affect the fixing properties. Moreover, the toner remained on the intermediate transfer belt 220 without being transferred is discharged to give the polarity of the positive side at the time when the transfer paper and the intermediate transfer belt 220 are separated, to thereby control the charge of the toner to 0 to the positive side. Note that, the jammed transfer paper or the toner image formed on the non-imaging area is not influenced from the secondary transferring, and therefore such toner remains to be negatively charged.

For example, a thickness of the photoconductor layer is adjusted to 30 μm, and the beam spot diameter of the optical system is adjusted to 50 μm×60 μm, and the luminous energy is adjusted to 0.47 mW. Then, the developing step is performed with the charging (exposure side) potential V0 of the photoconductor (black) 210Bk being −700 V, the potential VL thereof after the exposure being −120 V, and the developing bias voltage being −470 V, i.e., developing potential being 350 V. The developed image of the toner (black) formed on the photoconductor (black) goes through transferring (transferring to the intermediate transfer belt and to the transfer paper), and a fixing step, to be completed as an image. The transferring is performed by initially transferring images of all colors to the intermediate transfer belt 220 by the primary transferring devices (230Bk, 230C, 230M, 230Y), followed by transferring to the transfer paper by applying bias to another secondary transfer roller 170.

Next, the details of the photoconductor cleaning device will be explained. In FIG. 7, each developing device (200Bk, 200C, 200M, 200Y) and each cleaning device (300Bk, 300C, 300M, 300Y) are connected with each toner transporting pipe (250Bk, 250C, 250M, 250Y) (a dashed line in FIG. 7). Inside of each toner transporting pipe (250Bk, 250C, 250M, 250Y), a screw (not illustrated) is provided to transport the toner collected by each cleaning device (300Bk, 300C, 300M, 300Y) to each developing device (200Bk, 200C, 200M, 200Y).

In the conventional direct transfer system using a combination of four photoconductor drums and a belt transferring system, the photoconductor and transfer paper are directly in contact with each other. Therefore, the paper powder is deposited to the toner, and the recycled toner contains the paper powder. Such recycled toner could not be used for image formation as image defects, such as images containing toner-missing area, are caused. Further, in the conventional system using a combination of one photoconductor drum and an intermediate transferring system, deposition of paper powder to the photoconductor during transferring to the transfer paper is eliminated by employing an intermediate transfer member. However, in the case where the residual toner is recycled to the photoconductor, it is practically impossible to separate the toner of different colors once mixed. There is also a suggestion to use the mixed color toner as a black toner, but even when the toner particles of all colors are mixed, the resulting toner cannot make black. Moreover, the colors for use change depending on the print mode, and therefore recycling of the toner has been impossible with the structure containing one photoconductor.

In contrast, the aforementioned full color image forming apparatus uses the intermediate transfer belt 220, and therefore the toner has less contamination of paper powders, and deposition of the paper powder to the intermediate transfer belt 220 during transferring to paper can also be prevented. Since each photoconductor (210Bk, 210C, 210M, 210Y) uses an independent single color toner, it is not necessary to move each photoconductor cleaning device (300Bk, 300C, 300M, 300Y) closer or being apart, and the photoconductor cleaning devices can surely collect only the toner.

The positively charged toner remained on the intermediate transfer belt 220 is cleaned with an electric conductive fur brush 262, to which a negative voltage is applied. A method for applying a voltage to the electric conductive fur brush 262 is identical to that for the electric conductive fur brush 261, provided that the polarity is different. Almost all of the toner remained without being transferred is cleaned with the two electric conductive fur brushes 261,262. The toner, paper powder, and talc remained without being cleaned with the electric conductive fur brush 262 is negatively charged by the negative voltage of the electric conductive fur brush 262. The primary transfer of the black color, which is a sequential operation, is the transfer performed by a positive voltage, and the negatively charged toner etc. is attracted to the side of the intermediate transfer belt 220, and therefore the migration of the residual toner etc. to the side of the photoconductor (black) 210Bk can be prevented.

Next, one example of the intermediate transfer belt 220 for use in the image forming apparatus will be explained. The intermediate transfer belt is preferably a single layer resin layer, but it may further contain an elastic layer or a surface layer, if necessary.

A resin material constituting the resin layer is, for example, at least one or two or more selected from the group consisting of polycarbonate, a fluororesin (e.g., ETFE, and PVDF), a styrene resin (e.g., polystyrene, chloropolystyrene, poly-α-methylstyrene, a styrene-butadiene copolymer, a styrene-vinyl chloride copolymer, a styrene-vinyl acetate copolymer, a styrene-maleic acid copolymer, a styrene-acrylic acid ester copolymer, a styrene-methacrylic acid ester copolymer, a styrene-methyl-α-chloroacrylate copolymer, and styrene-acrylonitrile-acrylic acid ester copolymer), a methyl methacrylate resin, a butyl methacrylate resin, an ethyl acrylate resin, a butyl acrylate resin, a modified acrylic resin, a vinyl chloride resin, a styrene-vinyl acetate copolymer, a vinyl chloride-vinyl acetate copolymer, a rosin-modified maleic acid resin, a phenol resin, an epoxy resin, a polyester resin, a polyester polyurethane resin, polyethylene, polypropylene, polybutadiene, polyvinylidene chloride, an iomer resin, a polyurethane resin, a silicone resin, a ketone resin, an ethylene-ethyl acrylate copolymer, a xylene resin, a polyvinyl butyral resin, a polyamide resin, and a modified polyphenylene oxide resin. Note that, the material for the resin layer is not limited to those as listed above.

As for an elastic material (an elastic rubber or elastomer) for forming the elastic layer, usable is at least one selected from the group consisting of butyl rubber, fluororubber, acrylic rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, polyethylene chloride, urethane rubber, syndiotactic 1,2-polybutadiene, epichlorohydrin rubber, silicone rubber, fluorine rubber, polysulfide rubber, polynorbornene rubber, hydrogenated nitrile rubber, and thermoplastic elastomer. Needless to say that the elastic material is not limited to the above-listed materials.

Moreover, a material of the surface layer is not particularly limited, but it is required to reduce the adhesion of the toner to the surface of the intermediate transfer belt, and to enhance the secondary transfer properties. For example, preferred is a material having a small surface energy and high lubricity, and using one or two or more selected from polyurethane, polyester, an epoxy resin, and the like. As for such material, for example, usable is a material in which powder (e.g., a fluororesin, a fluorine compound, carbon fluoride, titanium dioxide, and silicon carbide), one type or two or more types of particles, or particles having different particles diameters are dispersed. Moreover, a material having a fluorine-rich layer at a surface, such as a fluororubber material, by performing a thermal treatment to make the surface energy thereof small can be used.

To the resin layer or elastic layer, for example, a resistance adjusting conductant agent is added. The resistance adjusting conductant agent is not particularly limited, and examples thereof include: metal powder such as carbon black, graphite, aluminum, and nickel; and electric conductive metal oxide, such as tin oxide, titanium oxide, antimony oxide, indium oxide, potassium titanate, antimony oxide-tin oxide complex oxide (ATO), and indium oxide-tin oxide complex oxide (ITO). The electric conductive metal oxide may be insulating particles (e.g., barium sulfate, magnesium silicate, and calcium carbonate) each having an electroconductive coating.

FIG. 8 illustrates another example of an image forming apparatus for use an image forming method of the present invention, and illustrates a photocopier 1000 equipped with a tandem indirect transferring system electrophotographic image forming apparatus. In FIG. 8, 110 is a main body of a copying device, 200 is a feeding table on which the main body the copying device 110 is provided, 300 is a scanner provided on the main body of the copying device, and 400 is an automatic document feeder (ADF) provided on the scanner. In the middle of the main body of the copying device 110, an intermediate transferring member 50 in the form of an endless belt is provided.

As illustrated in FIG. 8, the intermediate transfer member 50 is supported with three supporting rollers 14, 15, 16, and is configured to rotate in the clockwise direction in the figure. In this example illustrated in FIG. 8, an intermediate transfer member cleaning device 17, which is configured to remove the residual toner remained on the intermediate transfer member 50 after transferring images, is provided on the left side of the second supporting roller 15, out of these three rollers. On the upper side of the section of the intermediate transferring member 10, where the intermediate transferring member 10 is supported between the first supporting roller 14 and the second supporting roller 15 out of the three rollers, four image forming units 18 of yellow, cyan, magenta, and black are provided along the conveying direction of the intermediate transferring member 10 to constitute the tandem image forming apparatus 120.

Above the tandem image forming apparatus 120, as illustrated in FIG. 8, an exposing device 21 is provided. On the opposite side of the tandem image forming apparatus 120, a secondary transferring device 22 is provided with an intermediate transferring member 50 being in between. In the illustrated example, the secondary transferring device 22 contains a secondary transfer belt 24, which is an endless belt, provided around two rollers 23, and the secondary transfer belt 24 is provided against the third supporting roller 16 with the intermediate transfer member 50 being between them, to thereby transfer an image on the intermediate transfer member 50 to a sheet. Next to the secondary transferring device 22, a fixing device 25 configured to fix the transferred image on the sheet is provided. The fixing device 25 contains a fixing belt 26, which is an endless belt, and a pressing roller 27 provided to press against the fixing belt 26. The aforementioned secondary transferring device 22 also has a sheet transport faction of transporting the sheet to which the image has been transferred to the fixing device 25. Of course, a transfer roller or a non-contact charger may be provided as the secondary transferring device 22, but in such case, it is difficult to provide a sheet transporting function in combination. In the illustrated example, below the aforementioned secondary transferring device 22 and fixing device 25, a sheet reversing device 28 configured to reverse the sheet to perform image recording on both sides of the sheet is provided parallel to the aforementioned tandem image forming apparatus 120.

For making a copy using this color photographic device, a document is set on a document table of the automatic document feeder (ADF) 400. Alternatively, the automatic document feeder (ADF) 400 is opened, a document is set on a contact glass 32 of the scanner 300, and then the ADF 400 is closed.

In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from the first carriage 33 is reflected on the surface of the document, the reflected light from the document is further reflected by the second carriage 34, passed through an image forming lens 35 to receive a read sensor 36.

Moreover, when the start switch (not illustrated) is pressed, one of the supporting rollers 14, 15, 16 is driven by a driving motor (not illustrated) to rotate, and other two supporting rollers are rotated dependently to the rotation of the driven roller, to thereby rotate the intermediate transferring member 50. At the same time, a photoconductor 10 of each image forming unit 18 is rotated and a monocolor image of black, yellow, magenta, or cyan is formed on the respective photoconductor 10. These monocolor images are successively transferred on the intermediate transfer member 50 along the rotation of the intermediate transfer member 50, to thereby form a composite color image on the intermediate transfer member 50.

Meanwhile, as the start switch (not illustrated) is pressed, one of the feeding rollers 142 in the paper feeding table 200 is selectively rotated to eject sheets from one of multiple feeder cassettes 144 of a paper bank 143, the ejected sheets are separated one by one by a separation roller 145 to send to a feeder path 146, and then transported by a transport roller 147 into a feeder path 148 in the photocopying device main body 110. The recording paper transported in the feeder path 148 is then bumped against a registration roller 49 to stop.

Alternatively, sheets on a manual-feeding tray 51 are ejected, separated one by one by a separation roller 58 to guide into a manual feeding path 53, and then stopped by the registration roller 49.

Then, the registration roller 49 is rotated synchronously with the movement of the composite color image on the intermediate transferring member 50 to send a sheet into the space between the intermediate transferring member 50 and a secondary transferring device 22, to transfer the composite color image on the sheet by the secondary transferring device 22. In this manner, the color image is recorded on the sheet.

The sheet on which the image has been transferred is transported by the secondary transferring device 22 to a fixing device 25, and the transferred image is then fixed by heat and pressure applied from the fixing device 25. Next, the sheet is changed its traveling direction by a switch craw 55, and discharged by a discharging roller 56 to be stacked on an output tray 57. Alternatively, the sheet is changed its traveling direction by the switch craw 55 to guide into a sheet reversing device 28, and the sheet is reversed by the sheet reversing device 28 and guided to a transferring position to record an image on the back surface of the sheet, followed by discharging the sheet on the output tray 57 by the discharging roller 56.

The residual toner on the intermediate transferring member 50 from which the image has been transferred is removed by the intermediate transfer member cleaning device 17, to be ready again for image formation performed by the tandem image forming apparatus 120. Note that, the registration roller 49 is generally earthed at the time of the use, but it may be biased for removing paper dust of the recording paper.

EXAMPLES

The present invention will be more specifically explained through Examples hereinafter, but Examples shall not be construed as to limit the scope of the present invention. In the following descriptions of Examples, "part(s)" denotes "part(s) by mass" and "%" denotes "% by mass," unless otherwise stated.

Various measurements in Examples were performed in accordance with the methods described in the present specification.

Production Example 1

<Synthesis of Ketimine>

A reaction vessel equipped with a stirring rod and a thermometer was charged with 170 parts of isophorone diisocyanate and 75 parts of methyl ethyl ketone, and the mixture was allowed to react for 5 hours at 50° C., to thereby synthesize Ketimine Compound 1. The amine value of Ketimine Compound 1 was 418.

Production Example 2-1

<Synthesis of Non-Crystalline Polyester Resin A-1>

A reaction vessel equipped with a condenser, a stirrer, and a nitrogen inlet tube was charged with 3-methyl-1,5-pentanediol, isophthalic acid, adipic acid, and trimellitic anhydride, together with titanium tetraisopropoxide (1,000 ppm relative to a resin component), so that a molar ratio OH/COOH of the hydroxyl groups to the carboxyl group was 1.5, a diol component was composed of 100 mol % of 3-methyl-1,5-pentanediol, a dicarboxylic acid component was composed of 40 mol % of isophthalic acid and 60 mol % of adipic acid, and an amount of the trimellitic anhydride in the entire monomers was 1 mol %. Thereafter, the temperature was increased to 200° C. over about 4 hours, followed by increasing the temperature to 230° C. over 2 hours. The reaction was carried out until no flow component was formed. Thereafter, the reaction mixture was further allowed to react at reduced pressure of 10 mmHg to 15 mmHg for 5 hours, to thereby obtain Intermediate Polyester A-1.

Next, a reaction vessel equipped with a condenser, a stirrer, and a nitrogen inlet tube was charged with Intermediate Polyester A-1 and isophorone diisocyanate. The amounts of Intermediate Polyester A-1 and isophorone diisocyanate added were adjusted so that mol % of the isophorone diisocyanate was 4.0 mol % of the entire monomers constituting a non-crystalline polyester resin to be produced. Thereafter, the mixture was diluted with ethyl acetate to give a concentration of 50%, and the resulting mixture was allowed to react for 5 hours at 100° C., to thereby obtain Prepolymer A-1.

Moreover, to Prepolymer A-1 provided and stirred in a reaction vessel equipped with a heater, a stirrer, and a nitrogen inlet tube, Ktimine Compound 1 was added dropwise in an amount that the amine content of Ketimine Compound 1 became equimolar to the isocyanate content of Prepolymer A-1. After stirring for 10 hours at 45° C., a prepolymer elongation product was taken out.

The obtained prepolymer elongation product was dried at 50° C. under the reduced pressure until the residual amount of the ethyl acetate became 100 ppm or less, to thereby obtain Non-Crystalline Polyester Resin A-1. The physical properties of Non-Crystalline Polyester Resin A-1 are presented in Table 1.

Production Example 2-2

<Synthesis of Non-Crystalline Polyester Resin A-2>

A reaction vessel equipped with a condenser, a stirrer, and a nitrogen inlet tube was charged with 1,6-hexanediol, isophthalic acid, adipic acid, and trimellitic anhydride, together with titanium tetraisopropoxide (1,000 ppm relative to a resin component), so that a molar ratio OH/COOH of the hydroxyl groups to the carboxyl group was 1.5, a diol component was composed of 100 mol % of 1,6-hexanediol, a dicarboxylic acid component was composed of 80 mol % of isophthalic acid and 20 mol % of adipic acid and an amount of the trimellitic anhydride in the entire monomers was 1 mol %. Thereafter, the temperature was increased to 200° C. over about 4 hours, followed by increasing the temperature to 230° C. over 2 hours. The reaction was carried out until no flow component was formed. Thereafter, the reaction mixture was further allowed to react at reduced pressure of 10 mmHg to 15 mmHg for 5 hours, to thereby obtain Intermediate Polyester A-2.

Next, a reaction vessel equipped with a condenser, a stirrer, and a nitrogen inlet tube was charged with Intermediate Polyester A-2 and isophorone diisocyanate. The amounts of Intermediate Polyester A-2 and isophorone diisocyanate added were adjusted so that mol % of the isophorone diisocyanate was 4.0 mol % of the entire monomers constituting a non-crystalline polyester resin to be produced. Thereafter, the mixture was diluted with ethyl acetate to give a concentration of 50%, and the resulting mixture was allowed to react for 5 hours at 100° C., to thereby obtain Prepolymer A-2.

Moreover, to Prepolymer A-2 provided and stirred in a reaction vessel equipped with a heater, a stirrer, and a nitrogen inlet tube, Ktimine Compound 1 was added dropwise in an amount that the amine content of Ketimine Compound 1 became equimolar to the isocyanate content of Prepolymer A-2. After stirring for 10 hours at 45° C., a prepolymer elongation product was taken out.

The obtained prepolymer elongation product was dried at 50° C. under the reduced pressure until the residual amount of the ethyl acetate became 100 ppm or less, to thereby obtain Non-Crystalline Polyester Resin A-2. The physical properties of Non-Crystalline Polyester Resin A-2 are presented in Table 1.

Production Example 2-3

<Synthesis of Non-Crystalline Polyester Resin A-3>

A reaction vessel equipped with a condenser, a stirrer, and a nitrogen inlet tube was charged with 3-methyl-1,5-pentanediol, adipic acid, and trimellitic anhydride, together with titanium tetraisopropoxide (1,000 ppm relative to a resin component), so that a molar ratio OH/COOH of the hydroxyl groups to the carboxyl group was 1.5, a diol component was composed of 100 mol % of 3-methyl-1,5-pentanediol, a dicarboxylic acid component was composed of 100 mol % of adipic acid, and an amount of the trimellitic anhydride in the entire monomers was 1 mol %. Thereafter, the temperature was increased to 200° C. over about 4 hours, followed by increasing the temperature to 230° C. over 2 hours. The reaction was carried out until no flow component was formed. Thereafter, the reaction mixture was further allowed to react at reduced pressure of 10 mmHg to 15 mmHg for 5 hours, to thereby obtain Intermediate Polyester A-3.

Next, a reaction vessel equipped with a condenser, a stirrer, and a nitrogen inlet tube was charged with Intermediate Polyester A-3 and isophorone diisocyanate. The amounts of Intermediate Polyester A-3 and isophorone diisocyanate added were adjusted so that mol % of the isophorone diisocyanate was 4.0 mol % of the entire monomers constituting a non-crystalline polyester resin to be produced. Thereafter, the mixture was diluted with ethyl acetate to give a concentration of 50%, and the resulting mixture was allowed to react for 5 hours at 100° C., to thereby obtain Prepolymer A-3.

Moreover, to Prepolymer A-3 provided and stirred in a reaction vessel equipped with a heater, a stirrer, and a nitrogen inlet tube, Ktimine Compound 1 was added dropwise in an amount that the amine content of Ketimine Compound 1 became equimolar to the isocyanate content of Prepolymer A-3. After stirring for 10 hours at 45° C., a prepolymer elongation product was taken out.

The obtained prepolymer elongation product was dried at 50° C. under the reduced pressure until the residual amount of the ethyl acetate became 100 ppm or less, to thereby obtain Non-Crystalline Polyester Resin A-3. The physical properties of Non-Crystalline Polyester Resin A-3 are presented in Table 1.

Production Example 2-4

<Synthesis of Non-Crystalline Polyester Resin A-4>

A reaction vessel equipped with a condenser, a stirrer, and a nitrogen inlet tube was charged with 3-methyl-1,5-pentanediol, isophthalic acid, and trimellitic anhydride, together with titanium tetraisopropoxide (1,000 ppm relative to a resin component), so that a molar ratio OH/COOH of the hydroxyl groups to the carboxyl group was 1.5, a diol component was composed of 100 mol % of 3-methyl-1,5-pentanediol, a dicarboxylic acid was composed of 100 mol % of isophthalic acid, and an amount of the trimellitic anhydride in the entire monomers was 1 mol %. Thereafter, the temperature was increased to 200° C. over about 4 hours, followed by increasing the temperature to 230° C. over 2 hours. The reaction was carried out until no flow component was formed. Thereafter, the reaction mixture was further allowed to react at reduced pressure of 10 mmHg to 15 mmHg for 5 hours, to thereby obtain Intermediate Polyester A-4.

Next, a reaction vessel equipped with a condenser, a stirrer, and a nitrogen inlet tube was charged with Intermediate Polyester A-4 and isophorone diisocyanate. The amounts of Intermediate Polyester A-4 and isophorone diisocyanate added were adjusted so that mol % of the isophorone diisocyanate was 4.0 mol % of the entire monomers constituting a non-crystalline polyester resin to be produced. Thereafter, the mixture was diluted with ethyl acetate to give a concentration of 50%, and the resulting mixture was allowed to react for 5 hours at 100° C., to thereby obtain Prepolymer A-4.

Moreover, to Prepolymer A-4 provided and stirred in a reaction vessel equipped with a heater, a stirrer, and a nitrogen inlet tube, Ktimine Compound 1 was added dropwise in an amount that the amine content of Ketimine Compound 1 became equimolar to the isocyanate content of Prepolymer A-4. After stirring for 10 hours at 45° C., a prepolymer elongation product was taken out.

The obtained prepolymer elongation product was dried at 50° C. under the reduced pressure until the residual amount of the ethyl acetate became 100 ppm or less, to thereby obtain Non-Crystalline Polyester Resin A-4. The physical properties of Non-Crystalline Polyester Resin A-4 are presented in Table 1.

Production Example 2-5

<Synthesis of Non-Crystalline Polyester Resin A-5>

A reaction vessel equipped with a condenser, a stirrer, and a nitrogen inlet tube was charged with 3-methyl-1,5-pentanediol, isophthalic acid, adipic acid, and trimellitic anhydride, together with titanium tetraisopropoxide (1,000 ppm relative to a resin component), so that a molar ratio OH/COOH of the hydroxyl groups to the carboxyl group was 1.3, a diol component was composed of 100 mol % of 3-methyl-1,5-pentanediol, a dicarboxylic acid component was composed of 40 mol % of isophthalic acid and 60 mol % of adipic acid, and an amount of the trimellitic anhydride in the entire monomers was 1 mol %. Thereafter, the temperature was increased to 200° C. over about 4 hours, followed by increasing the temperature to 230° C. over 2 hours. The reaction was carried out until no flow component was formed. Thereafter, the reaction mixture was further allowed to react at reduced pressure of 10 mmHg to 15 mmHg for 5 hours, to thereby obtain Intermediate Polyester A-5.

Next, a reaction vessel equipped with a condenser, a stirrer, and a nitrogen inlet tube was charged with Intermediate Polyester A-5 and isophorone diisocyanate. The amounts of Intermediate Polyester A-5 and isophorone diisocyanate added were adjusted so that mol % of the isophorone diisocyanate was 8.0 mol % of the entire monomers constituting a non-crystalline polyester resin to be produced. Thereafter, the mixture was diluted with ethyl acetate to give a concentration of 50%, and the resulting mixture was allowed to react for 5 hours at 100° C., to thereby obtain Prepolymer A-5.

Moreover, to Prepolymer A-5 provided and stirred in a reaction vessel equipped with a heater, a stirrer, and a nitrogen inlet tube, Ktimine Compound 1 was added dropwise in an amount that the amine content of Ketimine Compound 1 became equimolar to the isocyanate content of Prepolymer A-5. After stirring for 10 hours at 45° C., a prepolymer elongation product was taken out.

The obtained prepolymer elongation product was dried at 50° C. under the reduced pressure until the residual amount of the ethyl acetate became 100 ppm or less, to thereby obtain Non-Crystalline Polyester Resin A-5. The physical properties of Non-Crystalline Polyester Resin A-5 are presented in Table 1.

Production Example 2-6

<Synthesis of Non-Crystalline Polyester Resin A-6>

A reaction vessel equipped with a condenser, a stirrer, and a nitrogen inlet tube was charged with 3-methyl-1,5-pentanediol, isophthalic acid, adipic acid, and trimellitic anhydride, together with titanium tetraisopropoxide (1,000 ppm relative to a resin component), so that a molar ratio OH/COOH of the hydroxyl groups to the carboxyl group was 1.3, a diol component was composed of 100 mol % of 3-methyl-1,5-pentanediol, a dicarboxylic acid component was composed of 40 mol % of isophthalic acid and 60 mol % of adipic acid, and an amount of the trimellitic anhydride in the entire monomers was 1 mol %. Thereafter, the temperature was increased to 200° C. over about 4 hours, followed by increasing the temperature to 230° C. over 2 hours. The reaction was carried out until no flow component was formed. Thereafter, the reaction mixture was further allowed to react at reduced pressure of 10 mmHg to 15 mmHg for 5 hours, to thereby obtain Intermediate Polyester A-6.

Next, a reaction vessel equipped with a condenser, a stirrer, and a nitrogen inlet tube was charged with Intermediate Polyester A-6 and isophorone diisocyanate. The amounts of Intermediate Polyester A-6 and isophorone diisocyanate added were adjusted so that mol % of the isophorone diisocyanate was 1.5 mol % of the entire monomers constituting a non-crystalline polyester resin to be produced. Thereafter, the mixture was diluted with ethyl acetate to give a concentration of 50%, and the resulting mixture was allowed to react for 7 hours at 100° C., to thereby obtain Prepolymer A-6.

Moreover, to Prepolymer A-6 provided and stirred in a reaction vessel equipped with a heater, a stirrer, and a nitrogen inlet tube, Ktimine Compound 1 was added dropwise in an amount that the amine content of Ketimine Compound 1 became equimolar to the isocyanate content of Prepolymer A-6. After stirring for 10 hours at 45° C., a prepolymer elongation product was taken out.

The obtained prepolymer elongation product was dried at 50° C. under the reduced pressure until the residual amount of the ethyl acetate became 100 ppm or less, to thereby obtain Non-Crystalline Polyester Resin A-6. The physical properties of Non-Crystalline Polyester Resin A-6 are presented in Table 1.

TABLE 1

| | Non-Crystalline Polyester Resin A | | | | | |
|---|---|---|---|---|---|---|
| | A-1 | A-2 | A-3 | A-4 | A-5 | A-6 |
| Mw | 150,000 | 120,000 | 90,000 | 120,000 | 140,000 | 90,000 |
| Tg (° C.) | −35 | 4.9 | −62 | 4.6 | −34 | −33 |
| Isocyanate monomer mol % | 4 | 4 | 4 | 4 | 8 | 1.5 |

Production Example 3-1

<Synthesis of Non-Crystalline Polyester Resin B-1>

A four-neck flask equipped with a nitrogen inlet tube, a dewatering tube, a stirrer, and a thermocouple was charged with bisphenol A ethylene oxide (2 mol) adduct, bisphenol A propylene oxide (3 mol) adduct, isophthalic acid, and adipic acid, so that a molar ratio [bisphenol A ethylene oxide (2 mol) adduct]/[bisphenol A propylene oxide (3 mol) adduct] of the bisphenol A ethylene oxide (2 mol) adduct to the bisphenol A propylene oxide (3 mol) adduct was 85/15, a molar ratio (isophthalic acid)/(adipic acid) of isophthalic acid to adipic acid was 80/20, and a molar ratio OH/COOH of the hydroxyl groups to the carboxyl groups was 1.4. The resulting mixture was reacted together with titanium tetraisopropoxide (500 ppm) for 8 hours at 230° C., and the resultant was further reacted at the reduced pressure of 10 mmHg to 15 mmHg for 4 hours to thereby obtain Intermediate Polyester B-1.

Next, a reaction vessel equipped with a stirrer and a nitrogen inlet tube was charged with Intermediate Polyester B-1 and isophorone diisocyanate. The amounts of Intermediate Polyester B-1 and isophorone diisocyanate added were adjusted so that mol % of the isophorone diisocyanate was 0.8 mol % of the entire monomers constituting a non-crystalline polyester resin to be produced. The resulting mixture was reacted for 4 hours at 200° C.

Finally, trimellitic anhydride was added to the reaction vessel so that the amount thereof was 1 mol % of the entire resin component, and the resulting mixture was allowed to react at 180° C. under the ambient pressure for 3 hours to thereby obtain Non-Crystalline Polyester Resin B-1. The physical properties thereof are presented in Table 2.

Production Example 3-2

<Synthesis of Non-Crystalline Polyester Resin B-2>

A four-neck flask equipped with a nitrogen inlet tube, a dewatering tube, a stirrer, and a thermocouple was charged with bisphenol A ethylene oxide (2 mol) adduct, bisphenol A propylene oxide (3 mol) adduct, isophthalic acid, and adipic acid, so that a molar ratio [bisphenol A ethylene oxide (2 mol) adduct]/[bisphenol A propylene oxide (3 mol) adduct] of the bisphenol A ethylene oxide (2 mol) adduct to the bisphenol A propylene oxide (3 mol) adduct was 75/25, a molar ratio (isophthalic acid)/(adipic acid) of isophthalic acid to adipic acid was 70/30, and a molar ratio OH/COOH of the hydroxyl groups to the carboxyl groups was 1.4. The resulting mixture was reacted together with titanium tetraisopropoxide (500 ppm) for 8 hours at 230° C., and the resultant was further reacted at the reduced pressure of 10 mmHg to 15 mmHg for 4 hours to thereby obtain Intermediate Polyester B-2.

Next, a reaction vessel equipped with a stirrer and a nitrogen inlet tube was charged with Intermediate Polyester B-2 and isophorone diisocyanate. The amounts of Intermediate Polyester B-2 and isophorone diisocyanate added were adjusted so that mol % of the isophorone diisocyanate was 0.6 mol % of the entire monomers constituting a non-crystalline polyester resin to be produced. The resulting mixture was reacted for 4 hours at 200° C.

Finally, trimellitic anhydride was added to the reaction vessel so that the amount thereof was 1 mol % of the entire resin component, and the resulting mixture was allowed to react at 180° C. under ambient pressure for 3 hours to thereby obtain Non-Crystalline Polyester Resin B-2. The physical properties thereof are presented in Table 2.

Production Example 3-3

<Synthesis of Non-Crystalline Polyester Resin B-3>

A four-neck flask equipped with a nitrogen inlet tube, a dewatering tube, a stirrer, and a thermocouple was charged with bisphenol A ethylene oxide (2 mol) adduct, bisphenol A propylene oxide (3 mol) adduct, isophthalic acid, and adipic acid, so that a molar ratio [bisphenol A ethylene oxide (2 mol) adduct]/[bisphenol A propylene oxide (3 mol) adduct] of the bisphenol A ethylene oxide (2 mol) adduct to the bisphenol A propylene oxide (3 mol) adduct was 75/25, a molar ratio (isophthalic acid)/(adipic acid) of isophthalic acid to adipic acid was 55/45, and a molar ratio OH/COOH of the hydroxyl groups to the carboxyl groups was 1.3. The resulting mixture was reacted together with titanium tetraisopropoxide (500 ppm) for 8 hours at 230° C., and the resultant was further reacted at the reduced pressure of 10 mmHg to 15 mmHg for 4 hours to thereby obtain Intermediate Polyester B-3.

Next, a reaction vessel equipped with a stirrer and a nitrogen inlet tube was charged with Intermediate Polyester B-3 and isophorone diisocyanate. The amounts of Intermediate Polyester B-3 and isophorone diisocyanate added were adjusted so that mol % of the isophorone diisocyanate was 0.6 mol % of the entire monomers constituting a non-crystalline polyester resin to be produced. The resulting mixture was reacted for 4 hours at 200° C.

Finally, trimellitic anhydride was added to the reaction vessel so that the amount thereof was 1 mol % of the entire resin component, and the resulting mixture was allowed to react at 180° C. under ambient pressure for 3 hours to thereby obtain Non-Crystalline Polyester Resin B-3. The physical properties thereof are presented in Table 2.

Production Example 3-4

<Synthesis of Non-Crystalline Polyester Resin B-4>

A four-neck flask equipped with a nitrogen inlet tube, a dewatering tube, a stirrer, and a thermocouple was charged with bisphenol A ethylene oxide (2 mol) adduct, and isophthalic acid, so that a molar ratio OH/COOH of the hydroxyl groups to the carboxyl groups was 1.2. The resulting mixture was reacted together with titanium tetraisopropoxide (1,000 ppm) for 10 hours at 230° C., and the resultant was further reacted at the reduced pressure of 10 mmHg to 15 mmHg for 4 hours to thereby obtain Intermediate Polyester B-4.

Next, a reaction vessel equipped with a stirrer and a nitrogen inlet tube was charged with Intermediate Polyester B-4 and isophorone diisocyanate. The amounts of Intermediate Polyester B-4 and isophorone diisocyanate added were adjusted so that mol % of the isophorone diisocyanate was 0.7 mol % of the entire monomers constituting a non-crystalline polyester resin to be produced. The resulting mixture was reacted for 4 hours at 200° C.

Finally, trimellitic anhydride was added to the reaction vessel so that the amount thereof was 1 mol % of the entire resin component, and the resulting mixture was allowed to react at 180° C. under ambient pressure for 3 hours to thereby obtain Non-Crystalline Polyester Resin B-4. The physical properties thereof are presented in Table 2.

Production Example 3-5

<Synthesis of Non-Crystalline Polyester Resin B-5>

A four-neck flask equipped with a nitrogen inlet tube, a dewatering tube, a stirrer, and a thermocouple was charged with bisphenol A ethylene oxide (2 mol) adduct, bisphenol A propylene oxide (3 mol) adduct, isophthalic acid, and adipic acid, so that a molar ratio [bisphenol A ethylene oxide (2 mol) adduct]/[bisphenol A propylene oxide (3 mol) adduct] of the bisphenol A ethylene oxide (2 mol) adduct to the bisphenol A propylene oxide (3 mol) adduct was 85/15, a molar ratio (isophthalic acid)/(adipic acid) of isophthalic acid to adipic acid was 80/20, and a molar ratio OH/COOH of the hydroxyl groups to the carboxyl groups was 1.4. The resulting mixture was reacted together with titanium tetraisopropoxide (500 ppm) for 8 hours at 230° C., and the resultant was further reacted at the reduced pressure of 10 mmHg to 15 mmHg for 4 hours. Thereafter, trimellitic anhydride was added to the reaction vessel so that the amount thereof was 1 mol % of the entire resin component, and the resulting mixture was allowed to react at 180° C. under ambient pressure for 3 hours to thereby obtain Non-Crystalline Polyester Resin B-5. The physical properties thereof are presented in Table 2.

Production Example 3-6

<Synthesis of Non-Crystalline Polyester Resin B-6>

A four-neck flask equipped with a nitrogen inlet tube, a dewatering tube, a stirrer, and a thermocouple was charged with bisphenol A ethylene oxide (2 mol) adduct, bisphenol A propylene oxide (3 mol) adduct, isophthalic acid, and adipic acid, so that a molar ratio [bisphenol A ethylene oxide (2 mol) adduct]/[bisphenol A propylene oxide (3 mol) adduct] of the bisphenol A ethylene oxide (2 mol) adduct to the bisphenol A propylene oxide (3 mol) adduct was 85/15, a molar ratio (isophthalic acid)/(adipic acid) of isophthalic acid to adipic acid was 80/20, and a molar ratio OH/COOH of the hydroxyl groups to the carboxyl groups was 1.5. The resulting mixture was reacted together with titanium tetraisopropoxide (1,000 ppm) for 10 hours at 230° C., and the resultant was further reacted at the reduced pressure of 10 mmHg to 15 mmHg for 4 hours to thereby obtain Intermediate Polyester B-6.

Next, a reaction vessel equipped with a stirrer and a nitrogen inlet tube was charged with Intermediate Polyester B-6 and isophorone diisocyanate. The amounts of Intermediate Polyester B-6 and isophorone diisocyanate added were adjusted so that mol % of the isophorone diisocyanate was 0.3 mol % of the entire monomers constituting a non-crystalline polyester resin to be produced. The resulting mixture was reacted for 4 hours at 200° C.

Finally, trimellitic anhydride was added to the reaction vessel so that the amount thereof was 1 mol % of the entire resin component, and the resulting mixture was allowed to react at 180° C. under ambient pressure for 3 hours to thereby obtain Non-Crystalline Polyester Resin B-6. The physical properties thereof are presented in Table 2.

TABLE 2

| | Non-Crystalline Polyester Resin B | | | | | |
|---|---|---|---|---|---|---|
| | B-1 | B-2 | B-3 | B-4 | B-5 | B-6 |
| Mw | 6,200 | 5,700 | 5,600 | 12,600 | 4,300 | 4,700 |
| Tg (° C.) | 52 | 39 | 25 | 75 | 45 | 48 |
| Isocyanate monomer mol % | 0.8 | 0.7 | 0.6 | 0.7 | 0 | 0.3 |

Production Example 4

<Synthesis of Crystalline Polyester Resin>

A 5-L four-neck flask equipped with a nitrogen inlet tube, a dewatering tube, a stirrer, and a thermocouple was charged with 2,300 g, of 1,10-decandioic acid, 2,530 g of 1,8-octanediol, and 4.9 g of hydroquinone, and the mixture was allowed to react at 180° C. for 10 hours. Then, the resultant was heated to 200° C. to react for 3 hours, followed by reacting for another 2 hours at 8.3 kPa to thereby obtain Crystalline Polyester Resin.

Production Example 5

<Synthesis of Master Batch (MB)>

Using HENSCHEL MIXER (manufactured by Nippon Cole & Engineering Co., Ltd.), 1,200 parts of water, 500 parts of carbon black (Printex35, manufactured by Evonik Degussa Japan Co., Ltd., DBP oil absorption amount: 42 mL/100 g, pH: 9.5), and 500 parts of Non-Crystalline Polyester Resin B-1 were mixed. The resulting mixture was kneaded by means of a two roll mill for 30 minutes at 150° C. The resulting kneaded product was rolled out and cooled, followed by pulverizing by a pulverizer, to thereby obtain Master Batch 1.

Production Example 6

<Preparation of Wax Dispersion Liquid>

A vessel equipped with a stirring rod and a thermometer was charged with 50 parts of paraffin was (HNP-9, hydrocarbon wax, manufactured by NIPPON SEIRO CO., LTD., melting point: 75° C., SP value: 8.8) serving as Releasing Agent 1, and 450 parts of ethyl acetate. The resulting mixture was heated to 80° C. with stirring, and the temperature was maintained at 80° C. for 5 hours, followed by cooling to 30° C. over 1 hour. The resultant was then dispersed by means of a bead mill (ULTRA VISCOMILL, manufactured by AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain Wax Dispersion Liquid.

Production Example 7

<Production of Crystalline Polyester Dispersion Liquid>

A vessel equipped with a stirring rod and a thermometer was charged with 50 parts of Crystalline Polyester Resin, and 450 parts of ethyl acetate. The resulting mixture was heated to 80° C. with stirring, and the temperature was maintained at 80° C. for 5 hours, followed by cooling to 30° C. over 1 hour. The resultant was then dispersed by means of a bead mill (ULTRA VISCOMILL, manufactured by AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain Crystalline Polyester Resin Dispersion Liquid.

Example 1

<Preparation of Oil Phase>

A vessel was charged with 500 parts of Wax Dispersion Liquid, 300 parts of Prepolymer A-1, 500 parts of Crystalline Polyester Resin Dispersion Liquid, 700 parts of Non-Crystalline Polyester Resin B-1, 100 parts of Master Batch 1, and 2 parts of Ketimine Compound 1, and the resulting mixture was mixed by means of TK Homomixer (manufactured by PRIMIX Corporation) at 5,000 rpm for 60 minutes, to thereby obtain Oil Phase 1.

<Synthesis of Styrene/Acryl Resin Particle 1 (Resin Particle A1)>

A reaction vessel equipped with a stirring rod and a thermometer was charged with 683 parts of water, 16 parts of a sodium salt of sulfuric acid ester of methacrylic acid-ethylene oxide adduct (ELEMINOL RS-30, manufactured by Sanyo Chemical Industries, Ltd.), 83 parts of styrene, 83 parts of methacrylic acid, 110 parts of butyl acrylate, and 1 part of ammonium persulfate, and the resulting mixture was stirred for 15 minutes at 400 rpm to prepare a white emulsion. The obtained emulsion was heated until the internal system temperature reached 75° C., and then was allowed to react for 5 hours. Subsequently, a 1% by mass aqueous ammonium persulfate solution (30 parts) was added to the reaction mixture, followed by aging for 5 hours at 75° C., to thereby prepare Resin Particle Dispersion Liquid A1, which was an aqueous dispersion liquid of a vinyl resin (a copolymer of styrene/methacrylic acid/butyl acrylate/sodium salt of sulfuric acid ester of methacrylic acid ethylene oxide adduct). The glass transition temperature Tg of Styrene/Acryl Resin Particles A1 as obtained was 62° C.

<Synthesis of Acryl Resin Particle 1 (Resin Particle B1)>

A reaction vessel equipped with a stirring rod and a thermometer was charged with 683 parts of water, 10 parts of distearyl dimethyl ammonium chloride (Cation DS, manufactured by Kao Corporation, 114 parts of methyl methacrylate, 50 parts of butyl acrylate, 1 part of ammonium persulfate, and 4 parts of ethylene glycol dimethacrylate, and the mixture was stirred at 400 rpm for 15 minutes, to thereby obtain a white emulsion. The obtained emulsion was heated until the internal system temperature reached 65° C., and then was allowed to react for 10 hours. Subsequently, a 1% by mass aqueous ammonium persulfate solution (30 parts) was added to the reaction mixture, followed by aging for 5 hours at 75° C., to thereby prepare an aqueous dispersion liquid of Acryl Resin Particle B1, as Acryl Resin Particle Dispersion Liquid B1. The glass transition temperature Tg of Acryl Resin Particles B1 was 79° C.

<Preparation of Aqueous Medium Phase>

Water (660 parts), 25 parts of Resin Particle Dispersion Liquid A1, 25 parts of a 48.5% sodium dodecyldiphenyl ether disulfonate aqueous solution (ELEMINOL MON-7, product of Sanyo Chemical Industries Ltd.), and 60 parts of ethyl acetate were mixed and stirred, to thereby obtain a milky white fluid (an aqueous phase). To the obtained fluid, 50 parts of Acryl Resin Particles B1 was added, to thereby obtain Aqueous Phase 1. As a result of the observation of Aqueous Phase 1 under an optical microscope, aggregates each having a size of several hundreds micrometers were observed.

It was confirmed under an optical microscope that the aggregates were separated and dispersed into smaller aggregates each having a size of several micrometers, by stirring Aqueous Phase 1 by means of TK Homomixer (manufactured by PRIMIX Corporation) at 8,000 rpm. Accordingly, it was expected that Acryl Resin Particles B1 were dispersed and deposited onto the droplets of the toner material component also in the emulsification of the toner material, which would be performed later. As mentioned, it is important for Acryl Resin Particles B1 to cause aggregation but to loosen their aggregated state upon application of shear force in order to uniformly deposit a surface of a toner.

<Emulsification and Removal of Solvent>

To a vessel with which Oil Phase 1 had been charged, 1,200 parts of Aqueous Phase 1 was added, and the resulting mixture was mixed by means of TK Homomixer at 13,000 rpm for 20 minutes, to thereby obtain Emulsified Slurry 1.

A vessel equipped with a stirrer and a thermometer was charged with Emulsified Slurry 1, and the solvent therein was removed at 30° C. for 8 hours, followed by aging at 45° C. for 4 hours, to thereby obtain Dispersion Slurry 1.

<Washing and Drying>

After filtering 100 parts of Dispersion Slurry 1, the following operations (1) to (4) were performed twice, to thereby obtain Filtration Cake 1.

(1): To the filtration cake, 100 parts of ion-exchanged water was added, and the mixture was mixed (at 12,000 rpm for 10 minutes) by TK Homomixer, followed by filtering the mixture.

(2): To the filtration cake obtained in (1), 100 parts of a 10% sodium hydroxide aqueous solution was added, and the mixture was mixed (at 12,000 rpm for 30 minutes) by TK Homomixer, followed by filtering the mixture under the reduced pressure.

(3): To the filtration cake obtained in (2), 100 parts of 10% hydrochloric acid was added, and the mixture was mixed (at 12,000 rpm for 10 minutes) by TK Homomixer, followed by filtering the mixture.

(4): To the filtration cake obtained in (3), 300 parts of ion-exchanged water was added, and the mixture was mixed (at 12,000 rpm for 10 minutes) by TK Homomixer, followed by filtering the mixture.

Filtration Cake 1 was dried with an air-circulating drier for 48 hours at 45° C., and was then passed through a sieve with a mesh size of 75 μm, to thereby prepare Toner Base Particles a.

<External Additive Treatment>

To 100 parts of Toner Base Particles a, 0.6 parts of hydrophobic silica having the average particle diameter of 100 nm, 1.0 part of titanium oxide having the average particle diameter of 20 nm, and 0.8 parts of hydrophobic silica particles having the average particle diameter of 15 nm were added and mixed by means of HENSCHEL MIXER, to thereby obtain Toner a.

Example 2

Toner b of Example 2 was obtained in the same manner as in Example 1, provided that Prepolymer A-1 was replaced with Prepolymer A-2.

Example 3

Toner c of Example 3 was obtained in the same manner as in Example 1, provided that Prepolymer A-1 was replaced with Prepolymer A-4.

Example 4

Toner d of Example 4 was obtained in the same manner as in Example 1, provided that Non-Crystalline Polyester Resin B-1 was replaced with Non-Crystalline Polyester Resin B-2.

Example 5

Toner e of Example 5 was obtained in the same manner as in Example 2, provided that Non-Crystalline Polyester Resin B-1 was replaced with Non-Crystalline Polyester Resin B-2.

Example 6

Toner f of Example 6 was obtained in the same manner as in Example 3, provided that Non-Crystalline Polyester Resin B-1 was replaced with Non-Crystalline Polyester Resin B-2.

Example 7

Toner g of Example 7 was obtained in the same manner as in Example 1, provided that in the course of the preparation of the oil phase, the amount of Crystalline Polyester Resin Dispersion Liquid was changed from 500 parts to 1,000 parts.

Example 8

Toner h of Example 8 was obtained in the same manner as in Example 1, provided that in the course of the preparation of the oil phase, the amount of Crystalline Polyester Resin Dispersion Liquid was changed from 500 parts to 2,000 parts, and the amount of Non-Crystalline Polyester Resin B-1 was changed from 700 parts to 550 parts.

Example 9

Toner i of Example 9 was obtained in the same manner as in Example 1, provided that Prepolymer A-1 was replaced with Prepolymer A-6.

Example 10

Toner j of Example 10 was obtained in the same manner as in Example 1, provided that Prepolymer A-1 was replaced with Prepolymer A-5.

Example 11

Toner k of Example 11 was obtained in the same manner as in Example 1, provided that in the course of the preparation of the oil phase, 700 parts of Non-Crystalline Polyester Resin B-1 was replaced with 350 parts of Non-Crystalline Polyester Resin B-1 and 350 parts of Non-Crystalline Polyester Resin B-2.

Example 12

Toner l of Example 12 was obtained in the same manner as in Example 1, provided that Prepolymer A-1 was replaced with Prepolymer A-4, and Resin Particle Dispersion Liquid A1 and Acryl Resin Particle Dispersion Liquid B1 were not used.

Comparative Example 1

Toner m of Comparative Example 1 was obtained in the same manner as in Example 1, provided that Prepolymer A-1 was replaced with Prepolymer A-3.

Comparative Example 2

Toner n of Comparative Example 2 was obtained in the same manner as in Example 1, provided that Non-Crystalline Polyester Resin B-1 was replaced with Non-Crystalline Polyester Resin B-3.

Comparative Example 3

Toner o of Comparative Example 3 was obtained in the same manner as in Example 1, provided that Non-Crystalline Polyester Resin B-1 was replaced with Non-Crystalline Polyester Resin B-4.

Comparative Example 4

Toner p of Comparative Example 4 was obtained in the same manner as in Example 1, provided that Non-Crystalline Polyester Resin B-1 was replaced with Non-Crystalline Polyester Resin B-5.

Comparative Example 5

Toner q of Comparative Example 5 was obtained in the same manner as in Example 1, provided that in the course of the preparation of the oil phase, the amount of Crystalline Polyester Resin Dispersion Liquid was changed from 500 parts to 0 parts.

Comparative Example 6

Toner r of Comparative Example 6 was obtained in the same manner as in Example 1, provided that Non-Crystalline Polyester Resin B-1 was replaced with Non-Crystalline Polyester Resin B-6.

<Evaluation>

With each of the obtained toners, a developer was produced in the following manner, and evaluated in the following manners. The results are presented in Table 3.

[Production of Carrier]

—Carrier—

| | |
|---|---|
| Acryl resin solution (solid content: 50%) | 21.0 parts |
| Guanamine solution (solid content: 70%) | 6.4 parts |
| Alumina particles [0.3 μm, specific resistance: $10^{14}(\Omega \cdot cm)$] | 7.6 parts |
| Silicone resin solution [solid content: 23% (SR2410: Dow Corning Toray Co., Ltd.)] | 65.0 parts |
| Aminosilane [solid content: 100% (SH6020: Dow Corning Toray Co., Ltd.)] | 1.0 part |
| Toluene | 60 parts |
| Butyl cellosolve | 60 parts |

The above-listed raw materials of the carrier were dispersed for 10 minutes by a homomixer, to thereby obtain a solution for forming a coating film of the acryl resin and the silicone resin, containing the alumina particles. Surfaces of baked ferrite powder [$(MgO)_{1.8}(MnO)_{49.5}(Fe_2O_3)_{48.0}$, the average particle diameter: 25 μm] used as cores were coated with the solution for forming a coating film by a spin coater (manufactured by Okada Seiko Co., Ltd.) to give a film thickness of 0.15 μm, and the resultant was dried to thereby obtain a coated ferrite powder. The obtained coated ferrite powder was left in an electric furnace at 150° C. for 1 hour to thereby bake the coated ferrite powder. After cooling the ferrite powder, bulks of the ferrite powder was passed through a sieve having an opening size of 106 μm, to thereby obtain a carrier. The measurement of the film thickness was performed by observing the cross-section of the carrier under a transmission electron microscope. The average vale of the measured film thicknesses was determined as a film thickness. In the manner as described, Carrier A having the weight average particle diameter of 35 μm was obtained.

[Production of Two-Component Developer]

Using each of Toners a to r and Carrier A, 7 parts of the toner and 100 parts of the carrier were uniformly mixed by means of a type of a turbula mixer, in which a container was rolled to perform stirring, and were charged to thereby produce Two Component Developers a to r.

<<Low Temperature Fixing Ability and Hot Offset Resistance>>

Using a photocopier MF2200 (manufactured by Ricoh Company Limited) whose fixing unit had been modified using a Teflon (registered trade mark) roller, a printing test was performed on Type 6200 paper (manufactured by Ricoh Company Limited).

Specifically, cold offset temperature (the minimum fixing temperature) and hot offset temperature (the maximum fixing temperature) were determined by varying the fixing temperature.

The evaluation conditions of the minimum fixing temperature included the linear velocity of the fed paper being 120 mm/sec to 150 mm/sec, bearing of 1.2 kgf/cm$^2$, and nip width of 3 mm.

Moreover, the evaluation conditions of the maximum fixing temperature included the linear velocity of the fed paper being 50 mm/sec, bearing of 2.0 kgf/cm$^2$, and nip width of 4.5 mm.

Note that, the evaluation criteria of the low temperature fixing ability are as follows.

[Evaluation Criteria]

A: the low temperature fixing ability is lower than 110° C.

B: the low temperature fixing ability is 110° C. or higher but lower than 120° C.

C: the low temperature fixing ability is 120° C. or higher

Moreover, the evaluation criteria of the hot offset resistance are as follows.

A: hot offset temperature (the maximum fixing temperature) is 190° C. or higher

B: hot offset temperature (the maximum fixing temperature) is 170° C. or higher but lower than 190° C.

C: hot offset temperature (the maximum fixing temperature) is lower than 170° C.

<Heat Resistant Storage Stability>

A 50 mL glass vessel was charged with the toner, and the toner in the vessel was left to stand for 24 hours in a thermostat of 50° C., followed by cooling to 24° C. The resultant was subjected to a penetration test (JIS K2235-1991) to measure a penetration degree, and based on the results thereof, the heat resistant storage stability of the toner was evaluated in accordance with the following evaluation criteria. Note that, the larger penetration degree means more excellent heat resistant storage stability. The toner having the penetration degree of less than 5 mm (C) is likely to cause a problem on practical use.

[Evaluation Criteria]

A: the penetration degree is 10 mm or greater

B: the penetration degree is 5 mm or greater, but less than 10 mm

C: the penetration degree is less than 5 mm

TABLE 3

| | Toner | Non-crystalline polyester resin A | Non-crystalline polyester resin B | Amount of crystalline polyester resin (mass %) | Amount of resin A + resin B (mass %) | Toner Tg (° C.) Tg 1st | Presence of resin particle layers A, B | Low temperature fixing ability | Offset resistance | Heat resistant storage stability |
|---|---|---|---|---|---|---|---|---|---|---|
| Ex. 1 | a | A-1 | B-1 | 4.8 | 81 | 29 | Present | A | A | A |
| Ex. 2 | b | A-2 | B-1 | 4.8 | 81 | 37 | Present | A | A | A |
| Ex. 3 | c | A-4 | B-1 | 4.8 | 81 | 35 | Present | A | A | A |
| Ex. 4 | d | A-1 | B-2 | 4.8 | 81 | 22 | Present | A | B | B |
| Ex. 5 | e | A-2 | B-2 | 4.8 | 81 | 31 | Present | A | A | A |
| Ex. 6 | f | A-4 | B-2 | 4.8 | 81 | 30 | Present | A | A | A |
| Ex. 7 | g | A-1 | B-1 | 9 | 77 | 27 | Present | A | A | A |
| Ex. 8 | h | A-1 | B-1 | 19 | 67 | 22 | Present | A | A | B |
| Ex. 9 | i | A-6 | B-1 | 4.8 | 81 | 24 | Present | A | B | B |
| Ex. 10 | j | A-5 | B-1 | 4.8 | 81 | 23 | Present | A | B | B |
| Ex. 11 | k | A-1 | B-1, B-2 | 4.8 | 81 | 26 | Present | A | A | A |
| Ex. 12 | l | A-4 | B-1 | 4.8 | 81 | 33 | Not | A | B | B |
| Comp. Ex. 1 | m | A-3 | B-1 | 4.8 | 81 | 21 | Present | A | C | C |
| Comp. Ex. 2 | n | A-1 | B-3 | 4.8 | 81 | 18 | Present | A | C | C |
| Comp. Ex. 3 | o | A-1 | B-4 | 4.8 | 81 | 42 | Present | C | A | A |
| Comp. Ex. 4 | p | A-1 | B-5 | 4.8 | 81 | 31 | Present | A | B | C |
| Comp. Ex. 5 | q | A-1 | B-1 | 0 | 85 | 34 | Present | C | A | B |
| Comp. Ex. 6 | r | A-1 | B-6 | 4.8 | 81 | 31 | Present | A | C | C |

In Table 3, "Amount of crystalline polyester resin" denotes an amount of the crystalline polyester resin in the toner. "An amount of resin A+resin B" denotes a total amount of the non-crystalline polyester resin A and the non-crystalline polyester resin B in the toner. "Presence of resin particle resin layers A, B" denotes whether or not the toner particle has a core particle and a shell provided on a surface of the core particle, and the shell contains the layer formed of styrene/acryl resin particles, and a layer formed of acryl resin particles.

As presented above, Examples 1 to 8 had excellent results in low temperature fixing ability and heat resistant storage stability.

In Comparative Example 1, Tg of Non-Crystalline Polyester Resin A-3 was low, and therefore Comparative Example 1 had insufficient heat resistant storage stability. In Comparative Example 2, Tg of Non-Crystalline Polyester Resin B-3 was low, and therefore Comparative Example 2 had insufficient heat resistant storage stability. In Comparative Example 3, Tg of Non-Crystalline Polyester Resin B-4 was too high, and therefore Comparative Example 3 had insufficient low temperature fixing ability. In Comparative Example 4, no urethane bond was present in Non-Crystalline Polyester Resin B-5 and a urethane-urethane interaction between the non-crystalline polyester resins was extremely weak, and therefore Comparative Example 4 had insufficient heat resistant storage stability. In Comparative Example 5, a crystalline polyester resin is not contained in the toner, and therefore sharp decrease in the melt viscosity, which is unique to a crystalline resin, did not occur, and therefore Comparative Example 5 had insufficient low temperature fixing ability. In Comparative Example 6, a proportion of the urethane bonds in Non-Crystalline Polyester Resin B-6 was small, and the interaction between the polyester resins was weak, and therefore Comparative Example 6 had insufficient heat resistant storage stability.

Embodiments of the present invention are, for example, as follows:

<1> A toner containing:

a colorant;

a releasing agent; and a binder resin, wherein the binder resin contains a crystalline polyester resin, and a non-crystalline polyester resin containing a urethane bond, or a urea bond, or both thereof, where the non-crystalline polyester resin containing a urethane bond, or a urea bond, or both thereof contains a first non-crystalline polyester resin containing a urethane bond, or a urea bond, or both thereof, and a second non-crystalline polyester resin containing a urethane bond, or a urea bond, or both thereof, wherein monomers constituting the first non-crystalline polyester resin contain an isocyanate monomer for forming the urethane bond, or the urea bond, or the both thereof, in an amount of 0.5 mol % or greater relative to a total amount of the monomers, wherein monomers constituting the second non-crystalline polyester resin contain an isocyanate monomer for forming the urethane bond, or the urea bond, or the both thereof, in an amount of 0.5 mol % or greater relative to a total amount of the monomers, wherein the first non-crystalline polyester resin has glass transition temperature of −60° C. or higher but lower than 10° C., and wherein the second non-crystalline polyester resin has glass transition temperature of 30° C. or higher but lower than 70° C.

<2> The toner according to <1>, wherein the non-crystalline polyester resin containing a urethane bond, or a urea bond, or both thereof is contained in the toner in an amount of 65% by mass or greater.

<3> The toner according to <1>, wherein the toner has glass transition temperature Tg1st of 20° C. or higher but lower than 40° C., as measured with first heating thereof in differential scanning calorimetry.

<4> The toner according to <1>, wherein the toner is obtained by preparing a solution or dispersion liquid of a toner material, which is prepared by dissolving or dispersing, in an organic solvent, the toner material containing the colorant, the releasing agent, and the binder resin.

<5> The toner according to <1>, wherein the crystalline polyester resin is contained in the toner in an amount of 2.0% by mass to 20% by mass.

<6> The toner according to <1>, wherein the toner contains toner particles, and each toner particle contains a core particle and a shell provided on a surface of the core particle, wherein the core particle contains the colorant, the releasing agent, and the binder resin, and wherein the shell contains a layer formed of styrene/acryl resin particles, and a layer formed of acryl resin particles.

<7> An image forming method, containing:

charging an electrophotographic photoconductor;

exposing the charged electrophotographic photoconductor to form a latent electrostatic image thereon;

developing the latent electrostatic image with a toner to form a toner image on the electrophotographic photoconductor;

primary transferring the toner image formed on the electrophotographic photoconductor to an intermediate transfer member;

secondary transferring the toner image, which has been transferred to the intermediate transfer member, to a recording medium;

fixing the toner image, which has been transferred to the recording medium, on the recording medium; and cleaning the toner remained on a surface of the electrophotographic photoconductor after the primary transferring, wherein the toner contains:

a colorant;

a releasing agent; and a binder resin, wherein the binder resin contains a crystalline polyester resin, and a non-crystalline polyester resin containing a urethane bond, or a urea bond, or both thereof, where the non-crystalline polyester resin containing a urethane bond, or a urea bond, or both thereof contains a first non-crystalline polyester resin containing a urethane bond, or a urea bond, or both thereof, and a second non-crystalline polyester resin containing a urethane bond, or a urea bond, or both thereof, wherein monomers constituting the first non-crystalline polyester resin contain an isocyanate monomer for forming the urethane bond, or the urea bond, or the both thereof, in an amount of 0.5 mol % or greater relative to a total amount of the monomers, wherein monomers constituting the second non-crystalline polyester resin contain an isocyanate monomer for forming the urethane bond, or the urea bond, or the both thereof, in an amount of 0.5 mol % or greater relative to a total amount of the monomers, wherein the first non-crystalline polyester resin has glass transition temperature of −60° C. or higher but lower than 10° C., and wherein the second non-crystalline polyester resin has glass transition temperature of 30° C. or higher but lower than 70° C.

<8> The image forming method according to <7>, wherein a linear speed of the toner image transferring to the recording medium in the secondary transferring is 100 mm/sec to 1,000 mm/sec, and transferring duration at a nip is 0.5 msec to 60 msec.

<9> The image forming method according to <7>, wherein the method employs a tandem electrophotographic image forming process.

<10> The image forming method according to <7>, wherein the non-crystalline polyester resin containing a urethane bond, or a urea bond, or both thereof is contained in the toner in an amount of 65% by mass or greater.

<11> The image forming method according to <7>, wherein the toner has glass transition temperature Tg1st of 20° C. or higher but lower than 40° C., as measured with first heating thereof in differential scanning calorimetry.

<12> The image forming method according to <7>, wherein the toner is obtained by preparing a solution or dispersion liquid of a toner material, which is prepared by dissolving or dispersing, in an organic solvent, the toner material containing the colorant, the releasing agent, and the binder resin.

<13> The image forming method according to <7>, wherein the crystalline polyester resin is contained in the toner in an amount of 2.0% by mass to 20% by mass.

<14> The image forming method according to <7>, wherein the toner contains toner particles, and each toner particle contains a core particle and a shell provided on a surface of the core particle, wherein the core particle contains the colorant, the releasing agent, and the binder resin, and wherein the shell contains a layer formed of styrene/acryl resin particles, and a layer formed of acryl resin particles.

This application claims priority to Japanese application No. 2011-273351, filed on Dec. 14, 2011, and incorporated herein by reference.

What is claimed is:

1. A toner comprising:

a colorant;

a releasing agent; and a binder resin, wherein the binder resin contains a crystalline polyester resin, and a non-crystalline polyester resin containing a urethane bond, or a urea bond, or both thereof, where the non-crystalline polyester resin containing a urethane bond, or a urea bond, or both thereof contains a first non-crystalline polyester resin containing a urethane bond, or a urea bond, or both thereof, and a second non-crystalline polyester resin containing a urethane bond, or a urea bond, or both thereof, wherein monomers constituting the first non-crystalline polyester resin contain an isocyanate monomer for forming the urethane bond, or the urea bond, or the both thereof, in an amount of 0.5 mol % or greater relative to a total amount of the monomers, wherein monomers constituting the second non-crystalline polyester resin contain an isocyanate monomer for forming the urethane bond, or the urea bond, or the both thereof, in an amount of 0.5 mol % or greater relative to a total amount of the monomers, wherein the first non-crystalline polyester resin has glass transition temperature of −60° C. or higher but lower than 10° C., and wherein the second non-crystalline polyester resin has glass transition temperature of 30° C. or higher but lower than 70° C.

2. The toner according to claim 1, wherein the non-crystalline polyester resin containing a urethane bond, or a urea bond, or both thereof is contained in the toner in an amount of 65% by mass or greater.

3. The toner according to claim 1, wherein the toner has glass transition temperature Tg1st of 20° C. or higher but lower than 40° C., as measured with first heating thereof in differential scanning calorimetry.

4. The toner according to claim 1, wherein the toner is obtained by preparing a solution or dispersion liquid of a toner material, which is prepared by dissolving or dispersing, in an organic solvent, the toner material containing the colorant, the releasing agent, and the binder resin.

5. The toner according to claim 1, wherein the crystalline polyester resin is contained in the toner in an amount of 2.0% by mass to 20% by mass.

6. The toner according to claim 1, wherein the toner contains toner particles, and each toner particle contains a core particle and a shell provided on a surface of the core particle, wherein the core particle contains the colorant, the releasing agent, and the binder resin, and wherein the shell contains a layer formed of styrene/acryl resin particles, and a layer formed of acryl resin particles.

7. An image forming method, comprising:

charging an electrophotographic photoconductor;

exposing the charged electrophotographic photoconductor to form a latent electrostatic image thereon;

developing the latent electrostatic image with a toner to form a toner image on the electrophotographic photoconductor;

primary transferring the toner image formed on the electrophotographic photoconductor to an intermediate transfer member;

secondary transferring the toner image, which has been transferred to the intermediate transfer member, to a recording medium;

fixing the toner image, which has been transferred to the recording medium, on the recording medium; and cleaning the toner remained on a surface of the electrophotographic photoconductor after the primary transferring, wherein the toner contains:

a colorant;

a releasing agent; and a binder resin, wherein the binder resin contains a crystalline polyester resin, and a non-crystalline polyester resin containing a urethane bond, or a urea bond, or both thereof, where the non-crystalline polyester resin containing a urethane bond, or a urea bond, or both thereof contains a first non-crystalline polyester resin containing a urethane bond, or a urea bond, or both thereof, and a second non-crystalline polyester resin containing a urethane bond, or a urea bond, or both thereof, wherein monomers constituting the first non-crystalline polyester resin contain an isocyanate monomer for forming the urethane bond, or the urea bond, or the both thereof, in an amount of 0.5 mol % or greater relative to a total amount of the monomers, wherein monomers constituting the second non-crystalline polyester resin contain an isocyanate monomer for forming the urethane bond, or the urea bond, or the both thereof, in an amount of 0.5 mol % or greater relative to a total amount of the monomers, wherein the first non-crystalline polyester resin has glass transition temperature of −60° C. or higher but lower than 10° C., and wherein the second non-crystalline polyester resin has glass transition temperature of 30° C. or higher but lower than 70° C.

8. The image forming method according to claim 7, wherein a linear speed of the toner image transferring to the recording medium in the secondary transferring is 100 mm/sec to 1,000 mm/sec, and transferring duration at a nip is 0.5 msec to 60 msec.

9. The image forming method according to claim 7, wherein the method employs a tandem electrophotographic image forming process.

10. The image forming method according to claim 7, wherein the non-crystalline polyester resin containing a urethane bond, or a urea bond, or both thereof is contained in the toner in an amount of 65% by mass or greater.

11. The image forming method according to claim 7, wherein the toner has glass transition temperature Tg1st of 20° C. or higher but lower than 40° C., as measured with first heating thereof in differential scanning calorimetry.

12. The image forming method according to claim 7, wherein the toner is obtained by preparing a solution or dispersion liquid of a toner material, which is prepared by dissolving or dispersing, in an organic solvent, the toner material containing the colorant, the releasing agent, and the binder resin.

13. The image forming method according to claim 7, wherein the crystalline polyester resin is contained in the toner in an amount of 2.0% by mass to 20% by mass.

14. The image forming method according to claim 7, wherein the toner contains toner particles, and each toner particle contains a core particle and a shell provided on a surface of the core particle, wherein the core particle contains the colorant, the releasing agent, and the binder resin, and wherein the shell contains a layer formed of styrene/acryl resin particles, and a layer formed of acryl resin particles.

* * * * *